US005187055A

United States Patent [19]

Kobayashi et al.

[11] Patent Number: 5,187,055

[45] Date of Patent: Feb. 16, 1993

[54] SILVER HALIDE COLOR PHOTOGRAPHIC MATERIAL

[75] Inventors: Hidetoshi Kobayashi; Yasuhiro Shimada; Seiji Ichijima; Yoshio Ishii, all of Kanagawa, Japan

[73] Assignee: Fuji Photo Film Co., Ltd., Kanagawa, Japan

[21] Appl. No.: 284,047

[22] Filed: Dec. 14, 1988

[30] Foreign Application Priority Data

Dec. 15, 1987 [JP] Japan ..... 62-316973
Nov. 21, 1988 [JP] Japan ..... 63-294306

[51] Int. Cl.[5] ..... G03C 7/36
[52] U.S. Cl. ..... 430/544; 430/557
[58] Field of Search ..... 430/544, 557, 389, 556

[56] References Cited

U.S. PATENT DOCUMENTS 2,186,735 1/1940 Schneider et al. ..... 430/556
4,095,984 6/1978 Seuyoshi et al. ..... 430/544
4,149,886 4/1979 Tanaka et al. ..... 430/557
4,447,563 10/1984 Ichijima et al. ..... 430/557
4,897,341 1/1990 Odenwalder et al. ..... 430/544

FOREIGN PATENT DOCUMENTS 3636824 5/1988 Fed. Rep. of Germany .
63-116153 5/1988 Japan .
1204680 9/1970 United Kingdom .

*Primary Examiner*—Richard L. Schilling

*Attorney, Agent, or Firm*—Sughrue, Mion, Zinn, Macpeak & Seas

[57] ABSTRACT

A silver halide color photographic material having at least one silver halide emulsion layer on a support, said photographic material containing at least one coupler represented by the following general formula (I) in a constituent layer, (I)

wherein $R_1$ and $R_2$, which may be the same or different, each represents an alkyl, alkoxy, alkylthio, alkylsulfonyl, alkoxycarbonyl, alkoxysulfonyl, aryl, aryloxy, arylthio, arylsulfonyl and aryloxycarbonyl group; $R_3$ and $R_4$, which may be the same or different, each represents a group by which benzene can be substituted; Z represents nonmetal atoms necessary to form a 5- to 7-membered single or condensed hetero ring together with the nitrogen atom; and m and n each represents an integer of from 0 to 4, and when they are each a plural number, a plural $R_3$ or a plural $R_4$ may be the same or different.

37 Claims, No Drawings

SILVER HALIDE COLOR PHOTOGRAPHIC MATERIAL

FIELD OF THE INVENTION

The present invention relates to a silver halide color photographic material which contains a photographic coupler, particularly a malondianilide coupler containing a specific substituent at an ortho position of each anilino group, and a heterocyclic group attached to the coupling active site via its nitrogen atom.

BACKGROUND OF THE INVENTION

In a silver halide color photographic material, a color image is formed by the reaction of a dye forming coupler (abbreviated as a coupler, hereinafter) with an aromatic primary amine developing agent oxidized by color development subsequent to the exposure of said material to light.

In the color image formation as described above, color reproduction is generally effected in accordance with the subtractive color process, that is, blue, green and red colors are reproduced by the image formation of yellow, magenta and cyan colors bearing complementary relationships to their respective colors. In general, a yellow color image is formed using an acylacetoamide coupler and a malondianilide coupler as yellow dye forming coupler (abbreviated as a yellow coupler, hereinafter), a magenta color image using a 5-pyrazolone coupler, a pyrazolotriazole coupler and the like as magenta coupler, and a cyan color image using a phenol coupler and a naphthol coupler as cyan coupler.

Yellow, magenta and cyan dyes to be obtained from those couplers are generally produced in silver halide emulsion layers sensitive to radiations which bear complementary relationships to the radiations absorbed by said dyes, respectively, or their respective adjacent layers.

As for the yellow couplers, acylacetamide couplers represented by benzoylacetanilide couplers and pivaroylacetanilide couplers have generally been employed, particularly for image formation. Since the former couplers exhibit great activities upon coupling with oxidized aromatic primary amine developing agents in the development step, and the yellow dyes produced therefrom have great extinction coefficients, they have mainly been used for photograph-taking color sensitive materials, which require high sensitivity, especially for color negative films, while the latter produces yellow dyes excellent in spectral absorption characteristics and fastness, so they have been used chiefly for color paper and color reversal films. On the other hand, malondianilide couplers described in French Patent 1,558,452, and U.S. Pat. Nos. 4,095,984, 4,149,886, 4,477,563 and 4,500,634 are characterized by their high coupling activities. Of these couplers, those of such a type that a coupling eliminable group is attached to the coupling active site via its nitrogen atom have been utilized as development inhibitor releasing coupler (so-called DIR coupler) owing to their particularly high coupling activities. As already well-known, DIR couplers produce such favorable effects as to improve the granularity through fine granulation of dye mottle (fine granulation of dye image), enhance the sharpness of image through edge effect, improve the color reproducibility through interlayer development inhibiting effect, and enable the control of gradation.

Since yellow dyes obtained from malondianilide couplers have relatively great molecular extinction coefficients, they have yellow densities even when used as additives for image forming couplers, that is, DIR couplers, as well as when used for image formation. Therefore, sufficient fastness is required of these color images. However, the color images obtained from malondianilide couplers are thermally unstable, so they have a serious problem in keeping quality upon storage in the dark.

SUMMARY OF THE INVENTION

A first object of the present invention is to provide a silver halide color photographic material containing a malondianilide coupler improved in fastness of color image produced therefrom, especially fastness to heat.

A second object of the present invention is to provide a silver halide color photographic material which contains a malondianilide coupler having a high coupling activity.

The above-described objects are attained with a silver halide color photographic material having at least one silver halide emulsion layer on a support, which contains at least one coupler represented by the following general formula (I) in a constituent layer:

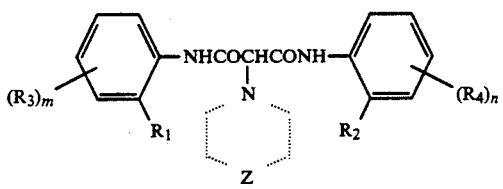

(I)

wherein $R_1$ and $R_2$, which may be the same or different, each represents an alkyl group, an alkoxy group, an alkylthio group, an alkylsulfonyl group, an alkoxycarbonyl group or an alkoxysulfonyl group which each contains from 2 to 24 carbon atoms, an aryl group, an aryloxy group, an arylthio group, or an arylsulfonyl group which each contains from 6 to 24 carbon atoms, or an aryloxycarbonyl group which contains from 7 to 24 carbon atoms ; $R_3$ and $R_4$, which may be the same or different, each represents a group by which benzene can be substituted; Z is nonmetal atoms necessary to complete a 5- to 7-membered single or condensed hetero ring together with the nitrogen atom; m and n each represent an integer of from 0 to 4; and when m or n is a plural number, a plural m $R_3$ (or a plural $R_4$) may be the same or different.

In the preferred embodiment, at least one of m and n represents zero and at least one of $R_3$ and $R_4$ represents an electron attractive group.

In the another preferred embodiment, both of m and n is not zero and at least one of $R_3$ and $R_4$ represents an electron attractive group.

DETAILED DESCRIPTION OF THE INVENTION

In malondianilide couplers which have so far been known, a group by which each anilide moiety is substituted at the ortho position is, in general, chlorine atom or methoxy group, though octyloxy group is known in α-(4-methoxyphenoxy)-2,2'-dioctyloxymalondianilide disclosed as Compound 16 in French Patent 1,558,452.

That patent aims at achievement of high coupling activity and prevention of stain upon storage, and has no description of the fastness of color image. In addition, the foregoing Compound 16 has an aryloxy substituent at its coupling active site, so it has not necessarily a sufficiently great coupling activity and cannot attain the objects of the present invention.

The couplers to be used in the present invention, which are represented by the foregoing general formula (I), are described in detail below.

$R_1$ and $R_2$, which may be the same or different, in the general formula (I) are each an alkyl group, an alkoxy group, an alkylthio group, an alkylsulfonyl group, an alkoxycarbonyl group, or an alkoxysulfonyl group, which each contains from 2 to 24 carbon atoms, an aryl group, an aryloxy group, an arylthio group, or an arylsulfony group, which each contains 6 to 24 carbon atoms, or an aryloxycarbonyl group which contains from 7 to 24 carbon atoms. The alkyl or aryl moiety of these groups may be substituted by a halogen atom (e.g., fluorine, chlorine, bromine, or iodine), an alkoxy group, an aryloxy group, an alkylthio group, an arylthio group, an aryl group, an alkoxycarbonyl group, a carbamoyl group, a carbonamido group, a sulfonamido group, a sulfamoyl group, a hydroxyl group, an acyl group, an acyloxy group, an imido group, an alkylsulfonyl group, an arylsulfonyl group, or so on. Further, the alkyl moiety may have a branched-chain or cyclic structure, while the aryl moiety may be substituted by an alkyl group. As specific examples of $R_1$ and $R_2$, mention may be made of alkyl groups (e.g., ethyl, n-butyl, n-hexyl, n-octyl, n-decyl, 2-decyl, phenetyl), aryl groups (e.g., phenyl, 1-naphthyl, 4-butoxyphenyl), alkoxy groups (e.g., ethoxy, n-butoxy, n-hexyloxy, n-octyloxy, 2-ethylhexyloxy, n-decyloxy, n-dodecyloxy, 2-decylthioethoxy, 2-hexyldecyloxy, 3-dodecyloxypropyl), aryloxy groups (e.g., phenoxy, 4-t-butylphenoxy, 4-octyloxyphenoxy), alkylthio groups (e.g., n-octylthio, 2-ethylhexylthio, n-decylthio, n-dodecylthio, n-hexadecylthio), arylthio groups (e.g., phenylthio, 4-dodecylphenylthio), alkylsulfonyl groups (e.g., n-octylsulfonyl, 2-ethylhexylsulfonyl, phenethylsulfonyl, n-decylsulfonyl, n-dodecylsulfonyl, 3-dodecyloxypropylsulfonyl), arylsulfonyl groups (e.g., p-tolylsulfonyl, 4-methoxyphenylsulfonyl, 4-dodecylphenylsulfonyl), alkoxycarbonyl groups (e.g., n-butoxycarbonyl, n-hexyloxycarbonyl, n-octyloxycarbonyl, 2-ethylhexyloxycarbonyl, 1-(octyloxycarbonyl)ethoxycarbonyl, n-decyloxycarbonyl, n-dodecyloxycarbonyl, n-hexadecyloxycarbonyl), and alkoxysulfonyl groups (e.g., n-octyloxysulfonyl, n-decyloxysulfonyl), and aryloxycarbony groups (e.g., phenoxy carbonyl). The number of carbon atoms contained in the group represented by $R_1$ or $R_2$, though must range from 2 to 24, preferably ranges from 4 to 20, more preferably 6 to 16. Of the groups set forth above, an alkoxy group, an alkylsulfonyl group or an alkoxycarbonyl group is preferred as $R_1$ or $R_2$. In particular, an alkylsulfonyl group or an alkoxycarbonyl group is of greater advantage.

$R_3$ and $R_4$ in the general formula (I) represent a group by which benzene can be substituted, with specific examples including halogen atoms (e.g., fluorine, chlorine, bromine, or iodine), alkyl groups (e.g., methyl, trifluoromethyl, trichloromethyl, ethyl, isopropyl, t-butyl, cyclopentyl, cyclohexyl, t-pentyl, 1,1,3,3-tetramethylbutyl, n-decyl), aryl groups (e.g., phenyl, p-tolyl, 2-chlorophenyl), alkoxy groups (e.g., methoxy, ethoxy, methoxyethoxy, benzyloxy, butoxy, n-octyloxy), aryloxy groups (e.g., phenoxy, 4-methoxyphenoxy), alkylthio groups (e.g., methylthio, ethylthio, hexylthio, benzylthio), arylthio groups (e.g., phenylthio, 4-chlorophenylthio), alkylsulfonyl groups (e.g., methylsulfonyl, ethylsulfonyl, trifluoromethylsulfonyl), arylsulfonyl groups (e.g., phenylsulfonyl, p-tolylsulfonyl), acyl groups (e.g., formyl, acetyl, benzoyl), acyloxy groups (e.g., acetoxy, benzoyloxy), carbonamido groups (e.g., acetamido, trifluoroacetamido, benzamido, octanamido), sulfonamido groups (e.g., methanesulfonamido, trifluoromethanesulfonamido, toluenesulfonamido), hydroxyl group, carboxyl group, sulfo group, cyano group, alkoxycarbonyl groups (e.g., methoxycarbonyl, ethoxycarbonyl), aryloxycarbonyl groups (e.g., phenoxycarbonyl, 4-methoxyphenoxycarbonyl), amino groups (e.g., amino, N-methylamino, N,N-dimethylamino, pyrrolidino, piperidino, morpholino), heteroayclic groups (e.g., 2-furyl, 2-thienyl, 4-pyridyl), imido groups (e.g., succinimido, phthalimido), carbamoyl groups (e.g., N-methylcarbamoyl), sulfamoy 1 groups (e.g., N,N-dimethylsulfamoyl), and so on.

m and n are each an integer of from 0 to 4, preferably from 0 to 2. The total number of carbon atoms contained in $(R_3)_m$ or $(R_4)_n$ ranges from 0 to 24.

In the general fOrmula (I),

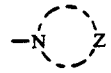

represents a 5- to 7-membered single or condensed heterocyclic group, with typical examples including 1-pyrrolyl, 1-pyrazolyl, 1-imidazolyl, 1,2,4-triazole-1-yl, 1,2,3-triazol-1-yl, 1,2,3-triazole-2-yl, 1,2,3,4-tetrazole-1-yl, succinimido, phthalimido, maleinimido, indolyl, indazole-1-yl, 1-benzotriazolyl, 2-benzotriazolyl, 2-pyridone-1-yl, 4-pyridone-1-yl, purine-7-yl, 1,2,4-triazolidine-3,5-dione-4-yl, imidazolidine-1,3,4-trione-1-yl, imidazolidine-2,4-dione-3-yl, oxazolidine-2,4-dione-3-yl, thiazolidine-2,4-dione-3-yl, tetrazolidine-5-one-1-yl, and so on. These heterocyclic rings each may be substituted by substituent groups as cited as examples of $R_3$ or $R_4$. Specific examples of such heterocyclic rings are described, e.g., in U.S. Pat. Nos. 3,730,722, 3,973,968, 3,990,896, 4,008,086, 4,022,620, 4,032,347, 4,049,458, 4,057,432, 4,095,934, 4,095,984, 4,115, 121, 4,133,958, 4,149,886, 4,206,238, 4,269,936, 4,477,563, 4,500,634 and 4,326,024, European Patent (EP) 30,747, JP-A-51-125319 (the term "JP-A" as used herein means an "unexamined published Japanese patent application"), JP-A-50-104022, JP-A-52-117627, JP-A-52-154631, JP-A-56-153343, JP-A-56-161543, JP-A-60-144740, JP-A-61-45247, JP-A-63-38938, JP-A-6 69 nd so on.

In the general formula (I),

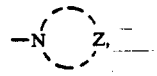

which is a eliminatable group from a coupler, is a development inhibitor residue, a bleach accelerator residue, a development accelerator residue and so on. Preferred

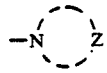

in the present invention includes 1-benzotriazolyl, 2-benzotriazolyl, 1,2,3-triazol-1-yl, 1,2,3-triazole-2-yl, oxazolidine-2,4-dione-3-yl, 1,2,4-triazolidine-3,5-dione-4-yl, 1,2,3,4-tetrazole-1-yl, tetrazolidine-5-one-1-yl and imidazolidone-1,3,4-trione-1-yl. Of these groups, 1-benzotriazolyl groups are especially preferred, and represented by the following general formula (II):

(II)

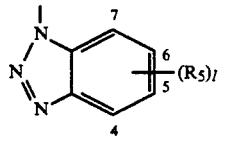

In the above-formula, $R_5$ represents a halogen atom (fluorine, chlorine, bromine, or iodine), nitro group, cyano group, an amino group (e.g., amino, dimethylamino, piperidino, morpholino, butylamino), an alkyl group (e.g., methyl, ethyl, propyl, n-butyl, isopropyl, t-butyl, cyclopentyl, 2-ethylhexyl), an aryl group (e.g., phenyl, 2-chlorophenyl, p-tolyl), an alkoxy group (e.g., methoxy, ethoxy, methoxyethoxy, butoxy, benzyloxy, phenethyloxy), an aryloxy group (e.g., phenoxy, 4-methoxyphenoxy, 4-acetamidophenoxy), an alkoxycarbonyl group (e.g., methoxycarbonyl, ethoxycarbonyl, 2-chloroethoxycarbonyl, 2-methoxyethoxycarbonyl, ethoxycarbonylmethoxycarbonyl, 2-cyanoethoxycarbonyl), an aryloxycarbonyl group (e.g., phenoxycarbonyl, 1-naphthoxycarbonyl, 4-methoxyphenoxycarbonyl, 4-chlorophenoxycarbonyl), an alkylthio group (e.g., methylthio, ethylthio, benzylthio), an arylthio group (e.g., phenylthio, 4-nitrophenylthio), a thiazolylideneamino group (e.g., N-methylbenzothiazolylideneamino, N-benzylbenzothiazolylideneamino), an alkylsulfonyl group (e.g., methylsulfonyl, benzylsulfonyl, butylsulfonyl), an arylsulfonyl group (e.g., phenylsulfonyl, p-tolylsulfonyl), an acyloxy group (e.g., acetoxy, benzoyloxy, trifluoroacetoxy, chloroacetoxy, butanoyloxy), a carbonamido group (e.g., acetamido, hexanamido, pentanamido, octanamido, benzamido), a sulfonamido group (e.g., butanesulfonamido, toluenesulfonamido), a carbamoyl group (e.g., carbamoyl, dimethylcarbamoyl, butylcabamoyl), a sulfamoyl group (e.g., diethylsulfamoyl, phenylsulfamoyl), an imido group (e.g., succinimido, phthalimido), an alkoxycarbonylamino group (e.g., ethoxycarbonylamino), an aryloxycarbonylamino group (e.g., phenoxycarbonylamino), or an ureido group (e.g., 3-butylureido, 3-phenylureido); and $\mu$ epresents an integer of from 0 to 4. When $\mu$ is not less than 2, $\mu R_5$'s may be the same or different. $R_5$ may be located at any of the positions 4, 5, 6 and 7 in the general formula (II). In general, it is located at the 5- or 6-position. The total number of the carbon atoms contained in $(R_5)\mu$ is preferably from 0 to 20, more preferably 0 to 10.

Specific examples of the groups (compounds) represented by the general formula (II) and their syntheses are described e.g., in U.S. Pat. Nos. 4,149,886, 4,477,563 and 4,500,634, JP-A-52-82424, JP-A-52-117627, and so on.

Of the compounds represented by the general formula (I), it is preferred to use a compoaned whose at least on $R_3$ and $R_4$ is an electron attractive substituent in view of its high coupling activity with an oxidized aromatic primary developing agent. The electron attractive substituent is a substituent whose Hammet's $\sigma_p$ value is not less than zero, preferably not less than 0.2.

Specific examples include a halogen atorn (e.g., chlorine, bromine, or iodine), trichloromethyl group, trifluoromethyl group, cyano group, acyl group, nitro group, carboxyl group, carbamoyl group, sulfamoyl group, alkoxycarbonyl group, alkylsulfonyl group, arylsulfonyl group, aryloxycarbonyl group, alkoxysulfonyl group, aryloxysulfonyl group, heterocyclic group (e.g., tetrazolyl, pyrolyl, benzotriazolyl, benzoxazolyl), imido group, acyloxy group, alkylsulfonyloxy group, arylsulfonyloxy group, trifluoromethoxy group, thiocyanate group, alkylsulfinyl group, and arylsulfinyl group. The Hammet's $\sigma_p$ value is disclosed, e.g., in C. Hansch et al, J. Med. Chem., 16, 1207(1973) and ibid, 20, 304(1977). Of these electron attractive groups, it is preferred to use a halogen atom, cyano group, nitro group, trifluoromethyl group, alkoxycarbonyl group, and aklylsulfinyl group in the present invention.

Specific examples of the couplers represented by the general formula (I) to be used in the present invention are illustrated below. However, the invention should not be construed as being limited to these examples.

Cp-(1)

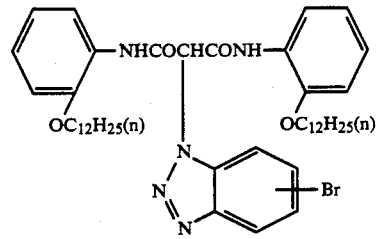

Cp-(2)

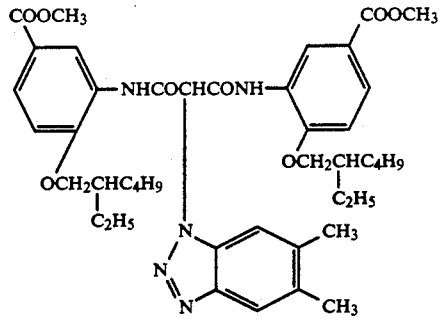

Cp-(3)

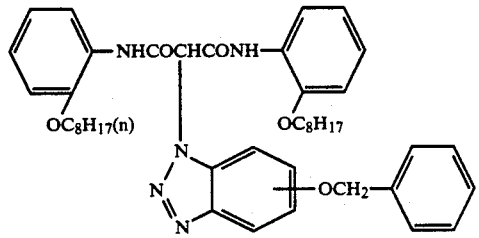

-continued
Cp-(4)
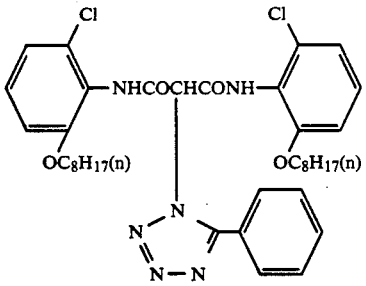
Cp-(5)
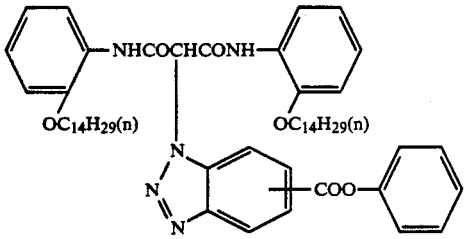
Cp-(6)
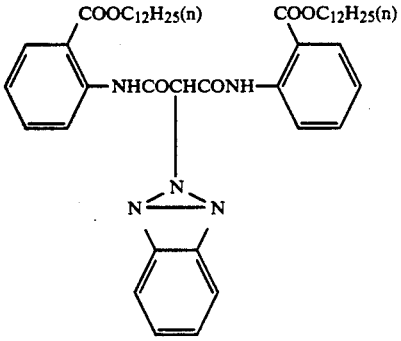
Cp-(7)
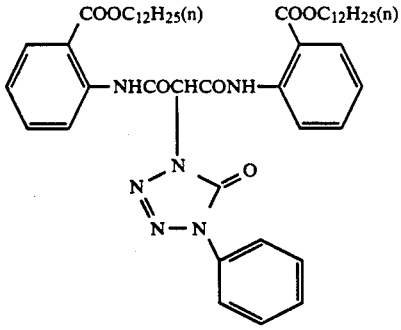
Cp-(8)
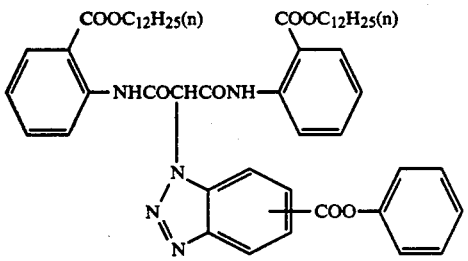
-continued
Cp-(9)
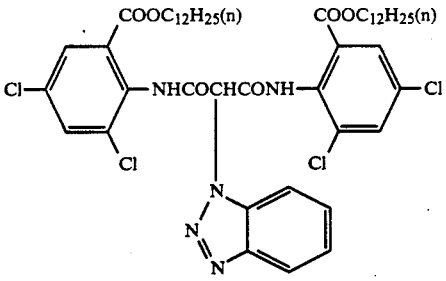
Cp-(10)
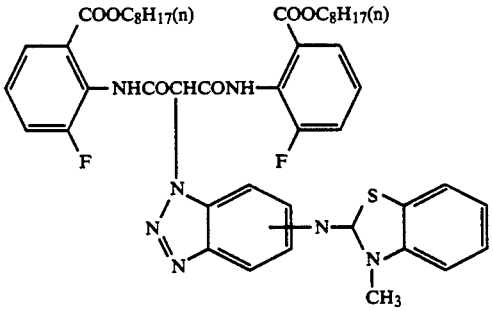
Cp-(11)
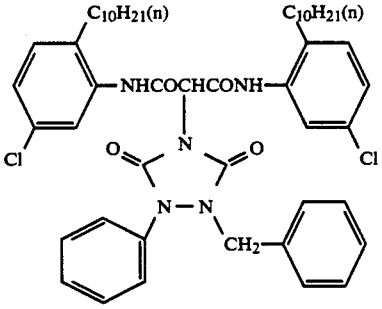
Cp-(12)
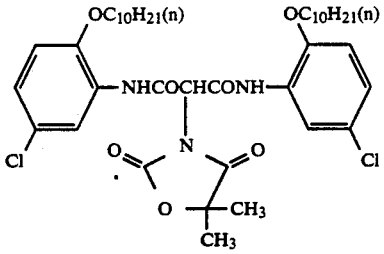
Cp-(13)
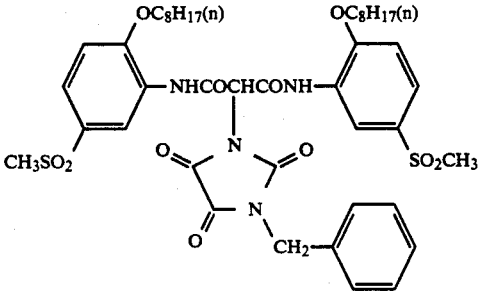

-continued
Cp-(14)
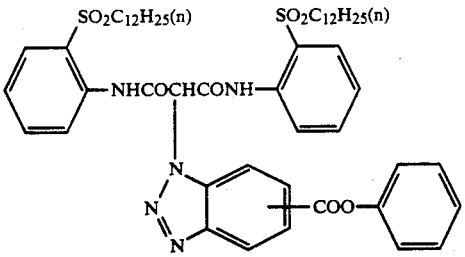
Cp-(15)
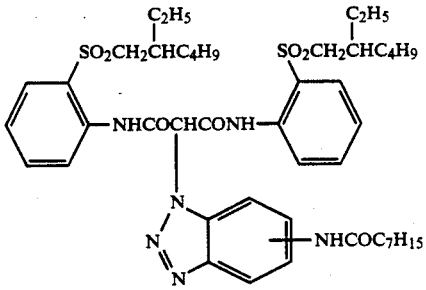
Cp-(16)
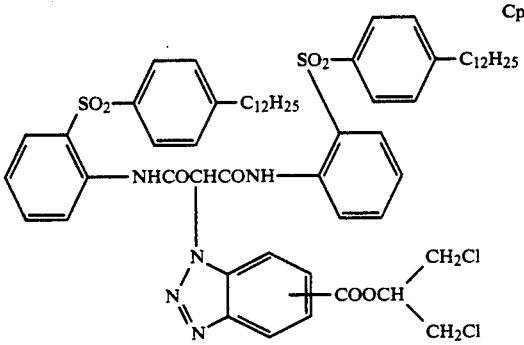
Cp-(17)
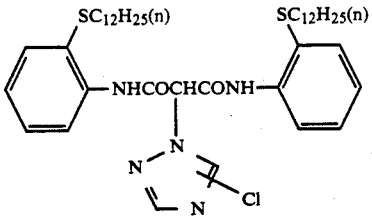
Cp-(18)
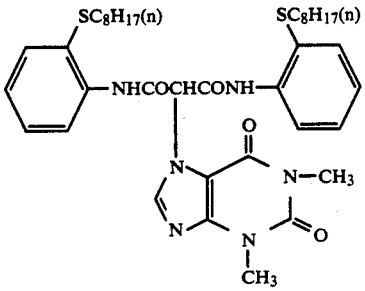
-continued
Cp-(19)
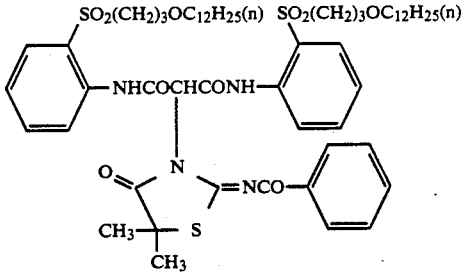
Cp-(20)
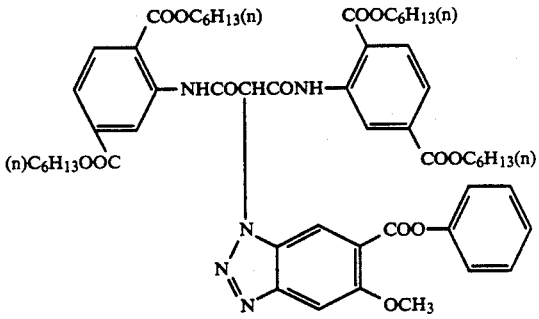
Cp-(21)
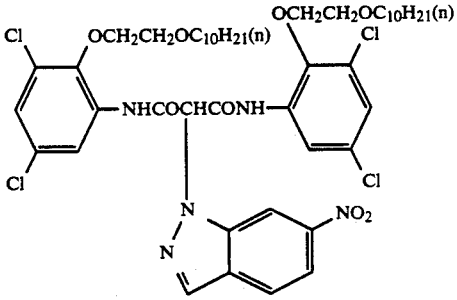
Cp-(22)
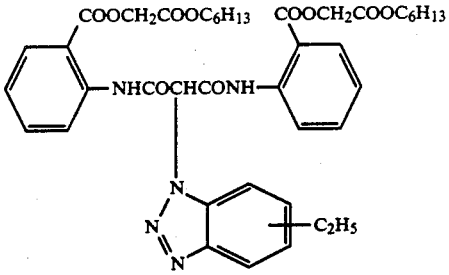
Cp-(23)
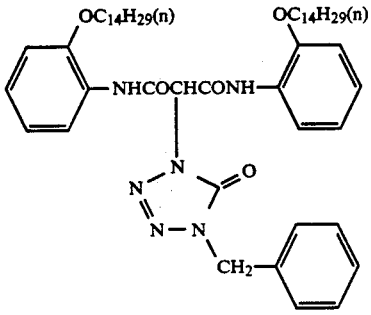

-continued
Cp-(24)
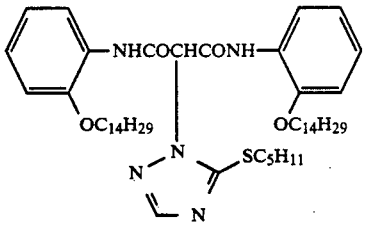
Cp-(25)
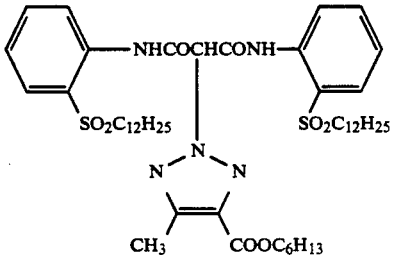
Cp-(26)
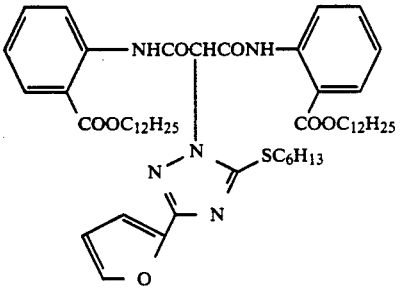
Cp-(27)
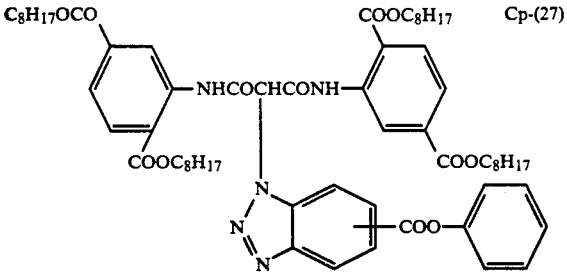
Cp-(28)
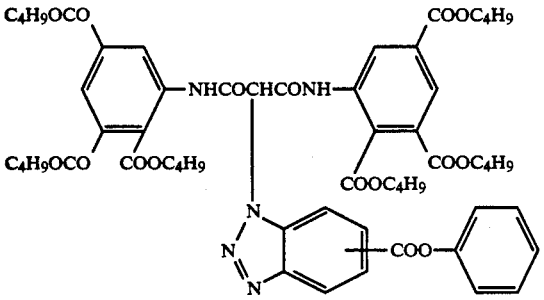
-continued
Cp-(29)
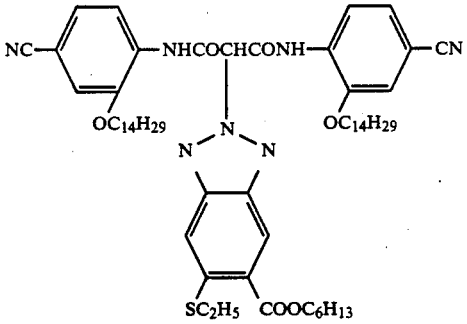
Cp-(30)
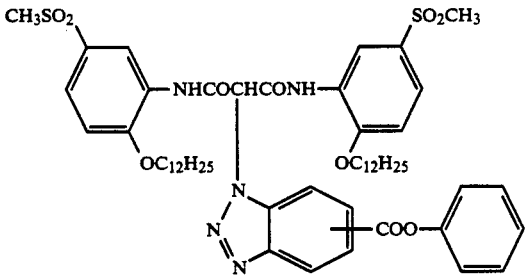
Cp-(31)
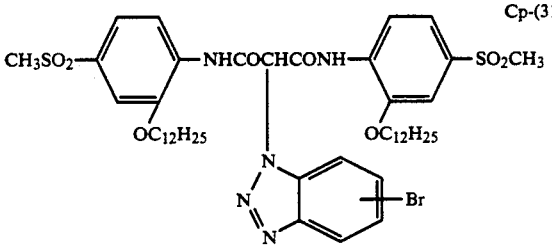
Cp-(32)
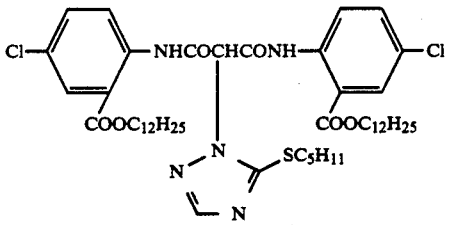
Cp-(33)
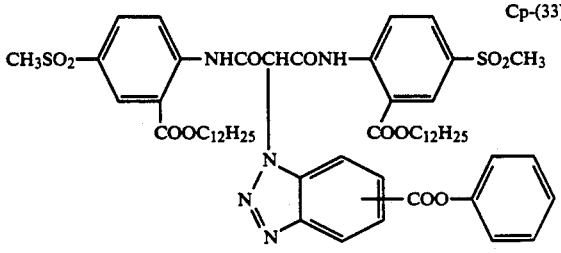

-continued

Cp-(34)

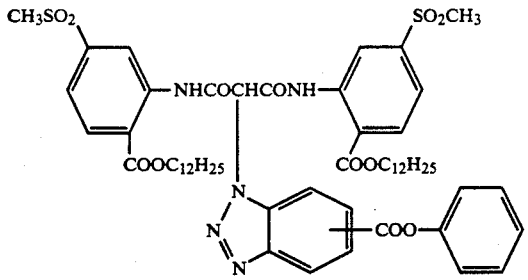

These couplers represented by the general formula (I) can be synthesized in accordance with the methods described in the foregoing patents including U.S. Pat. No. 3,730,722 and others. Typical synthesis examples are described below.

SYNTHESIS EXAMPLE 1

Synthesis of Coupler Cp-(5)

(a) Synthesis of Malonic Acid Di-2-tetradecyloxyanilide:

80.0 g of 2-tetradecyloxyaniline and 13.6 g of malonic acid were dissolved in a mixture of 200 ml of ethyl acetate and 300 ml of acetonitrile. Thereto, 56.8 g of dicyclohexylcarbodiimide dissolved in 200 ml of acetonitrile was added dropwise over a period of about 20 minutes. At the conclusion of the reaction, the reaction mixture was filtered, and the filtrate was concentrated. 500 ml of acetonitrile was added to the concentrate to crystalize the product out of the solution. The resulting crystals was filtered off and dried. Thus, 62.5 g of malonic acid di-2-tetradecyloxyanilide was obtained (Yield: 35.1%):

(b) Synthesis of Coupler Cp-(5)

A 20.0 g portion of the malonic acid di-2-tetradecyloxyanilide was dissolved in 200 ml of methylene chloride, and cooled in an ice bath. Thereto, 4.8 g of bromine was added dropwise for 5 minutes. The reaction solution was washed in succession with 100 ml of water, and then with 100 ml of an aqueous solution of sodium hydrogen carbonate, and then dried over calcium chloride. Thereafter, the washed solution was added dropwise to 100 ml of methylene chloride containing 13.9 g of 5-phenoxycarbonylbenzotriazole and 5.9 g of triethylamine at room temperature over a period of about 30 minutes. After about one hour's stirring, the reaction solution was washed in succession with 200 ml of water, and then with 200 ml of a sodium carbonate aqueous solution. Then, it was dried over sodium sulfate, and concentrated. 100 ml of isopropyl alcohol was added to the concentrate to crystallize the product out of the solution. The crystalline product were filtered off, and dried to give 15.6 g of the intended coupler (5) in a 58.8% yield. Melting Point 119°–120° C.

SYNTHESIS EXAMPLE 2

Synthesis of Coupler Cp-(8)

(a) Synthesis of Dodecyl o-Nitrobenzoate

A mixture of 83.5 g of o-nitrobenzoic acid, 1 ml of dimethylformamide and 100 ml of thionyl chloride was heated under reflux for 3 hours. The resulting reaction mixture was concentrated under reduced pressure with an aspirator to yield yellow, oily o-nitrobenzoyl chloride. The thus obtained o-nitrobenzoyl chloride was added dropwise to 300 ml of acetonitrile, in which 88.4 g of n-dodecanol and 41 ml of pyridine were dissolved, at room temperature with stirring over a period of 30 minutes. After one hour's stirring, the resulting solution was mixed with 600 ml of ethyl acetate, and washed three times with 500 ml of water being used for each wash, to extract the product with the ethyl acetate. The ethyl acetate solution was dried over sodium sulfate, and then concentrated to give 143 g of light yellow oily dodecyl o-nitrobenzoate.

(b) Synthesis of Dodecyl o-Aminobenzoate

A mixture of 3 g of ammonium chloride, 60 ml of water and 300 ml of isopropanol was heated in a stream of nitrogen under reflux. Thereto, a 67 g portion of the obtained dodecyl o-aminobenzoate was added dropwise over a 15-minute period. The reaction mixture was heated under reflux for 30 minutes, and then filtered out under reduced pressure. The filtrate was concentrated under reduced pressure, mixed with 300 ml of ethyl acetate, washed with 200 ml each of water for twice, dried over sodium sulfate, and then concentrated. Thus, 58.6 g of yellow oily dodecyl o-aminobenzoate was obtained.

(c) Synthesis of Malonic Acid Di-2-dodecyloxycarbonylanilide 22.9 g of malonic acid and 139.5 g of dodecyl o-aminobenzoate were dissolved in 240 ml of dimethylformamide. Thereto, 94.2 g of dicyclohexylcarbodiimide dissolved in 40 ml of dimethylformamide was added dropwise at room temperature over a 30-minute period with stirring. After the conclusion of the addition, the reaction solution was heated at 80° C. on a steam bath with stirring over a period of 5 hours, and then cooled. The cooled reaction solution was filtered out under reduced pressure, and the filtrate was mixed with 600 ml of ethyl acetate to extract the product. The ethyl acetate solution was dried over sodium sulfate, and then concentrated under reduced pressure. Upon adding ethanol to the concentrate, the product crystallized out of the solution. The crystalline product was filtered off, and dried. Thus, 133.1 g of malonic acid di-2-dodecyloxycarbonylanilide was obtained (in a 89.1% yield). Melting Point 65°–67° C.

(d) Synthesis of Coupler Cp-(8)

A 33.9 g portion of the foregoing product, or malonic acid di-2-dodecyloxycarbonylanilide, was dissolved in 150 ml of methylene chloride, and thereto was dropwise added 8.4 g of bromine for 15 minutes under an ice-cooled condition. At the conclusion of the dropwise addition, the ice bath was removed, and the mixture continued to undergo the reaction for 1 hour at room temperature, washed with water, and then dried over calcium chloride. The resulting methylene chloride solution was added dropwise over a period of about 1 hour to 100 ml of methylene chloride solution containing 23.9 g of 5-phenoxycarbonylbenzotriazole and 14 ml of triethylamine. After the conclusion of the dropwise addition, the stirring was continued for additional 5 hours. The resulting reaction solution was washed in succession with dilute hydrochloric acid and then with water. Then, it was dried over sodium sulfate, and concentrated. To the concentrate, an n-hexane/ethyl acetate (5/1) mixture was added, and excess 5-phenoxycarbonylbenzotriazole separating out upon standing was filtered out. The resulting filtrate was concentrated, and thereto was added ethanol to crystallize the product from the solution. The crystalline product was filtered off, and dried to give 19.1 g of the intended coupler Cp-(8) (in a 41.6% yield). Melting Point 76°-77° C.

SYNTHESIS EXAMPLE 3

Synthesis of Coupler Cp-(14)

(a) Synthesis of 2-Dodecylthionitrobenzene

A mixture of 16.8 g of sodium hydride (60%) and 400 ml of dimethylformamide was stirred at room temperature in a stream of nitrogen, and thereto was dropwise added 81 g of dodecyl mercaptan over a period of about 1 hour. After 2 hours' stirring, the reaction mixture was cooled in an ice bath, and thereto was dropwise added 30 ml of a dimethylformamide solution containing 63 g of o-chloronitrobenzene over a period of 30 minutes. After 2 hours' stirring at room temperature, the reaction solution was mixed with in succession with ethyl acetate, dilute hydrochloric acid, and water to extract the product. The resulting ethyl acetate solution was dried over sodium sulfate, and then concentrated to give 123 g of yellow oily 2-dodecylthionitrobenzene in a 95% yield.

(b) Synthesis of 2-Dodecylsulfonylnitrobenzene 36.2 g of 2-chloroperbenzoic acid was added dropwise to a 32.3 g portion of the foregoing 2-dodecylthionitrobenzene, dissolved in 400 ml of methylene chloride, at 0° C. with stirring over a 30-minute period. After the conclusion of the dropwise addition, the reaction mixture was stirred for 2 hours at a temperature below 5° C., and for an additional 3 hours at room temperature. The thus deposited 2-chlorobenzoic acid was filtered out, and the filtrate was washed with water, and dried over sodium sulfate. Therefrom, the methylene chloride was distilled away under reduced pressure. Upon addition of n-hexane, 21.1 g of white crystals of 2-dodecylsulfonylnitrobenzene separated out. Yield 59.4%. Melting Point 47°-48° C.

(c) Synthesis of 2-Dodecylsulfonylaniline 50.9 g of light yellow oily 2-dodecylsulfonylaniline was prepared from 59.4 g of the foregoing 2-dodecylsulfonylnitrobenzene in the same manner as dodecyl o-aminobenzoate in Synthesis Example 2. Yield 93.5%.

(d) Synthesis of Malonic Acid Di-2-dodecylsulfonylanilide;

15 ml of a dimethylformamide solution containing 32.2 g of dicyclohexylcarbodiimide was added dropwise to 80 ml of a dimethylformamide solution containing 8.13 g and the foregoing 2-dodecylsulfonylaniline at room temperature over a 30-minute period with stirring. After the conclusion of dropwise addition, the reaction mixture was further stirred for 30 minutes at room temperature, and for an additional 5 hours at 80° C. Then, the reaction solution was cooled with water, and therefrom was removed dicyclohexylurea by filtration under reduced pressure. The resulting filtrate was mixed with 300 ml of ethyl acetate, and washed with water to extract the product. The ethyl acetate solution obtained was dried over sodium sulfate, concentrated, and mixed with methanol to deposit crystals. The crystals were filtered off, and dried to give 34.8 g of malonic acid di-2-dodecylsulfonylanilide in a 62% yield. Melting Point 70°-71° C.

(e) Synthesis of Coupler Cp-(14)

8.0 g of bromine was added dropwise to 150 ml of a methylene chloride solution containing 34.3 g of the foregoing malonic acid di-2-dodecylsulfonylanilide over a 15-minute period with stirring under an ice-cooled condition. After the conclusion of the dropwise addition, the ice bath was removed, and the reaction mixture was further stirred for 1 hour at room temperature, followed by washing with water. The resulting methylene chloride solution was dried over calcium chloride, and then added dropwise to 100 ml of a methylene chloride solution containing 22.8 g of 5-phenoxycarbonylbenzotriazole and 13.4 ml of triethylamine at room temperature over a 1-hour period. After the conclusion of the addition, the reaction solution was stirred for 3 hours, and washed in succession with dilute hydrochloric acid, and water. The resulting methylene chloride solution was dried over sodium sulfate, concentrated, and then mixed with 250 ml of ethyl acetate to deposit crystals. The crystals were filtered off, and dried to give 27.4 g of the intended coupler Cp-(14) in a 60% yield. Melting Point 128°-30° C.

SYNTHESIS EXAMPLE 4

Synthesis of Coupler Cp-(27)

(a) Synthesis of Octyl 2-nitroterephatate

A mixture of 23.9 g of methyl 2-nitroterephtalate, 28.6 g of n-octanol and 1 ml of n-butyl orthotitanate was stirred for 5 hours at 140° C. in a nitrogen steam, and thereto was added 300 ml of ethyl acetate and washed with 500 ml of water for twice. Then, the ethyl acetate layer was concentrated to obtain 50 g of oily octyl 2-nitroterephthalate.

(b) Synthesis of Octyl 2-nitroaminoterephthalate

A mixture of 2 g of ammonium chloride, 50 ml of water and 250 ml of isopropanol was heated in a stream of nitrogen under reflux, and thereto was dropwise added 50 g of octyl 2-nitroterephthalate. After the conclusion of the dropwise addition, the reaction mixture was refluxed for 30 minutes and filtrated out by a Nutsche coated sellaite therein. To the filtrate was added 500 ml of ethyl acetate and washed with water, and then concentrated to give 43.2 g of oily octyl 2-aminotetrephalate.

(c) Synthesis of Malonic Acid Bis-(2,5-dioclyloxycarbonylamilide)

A mixture of 40.5 g of octyl 2-aminotetraphthalate, 5.2 g of malonic acid and 50 ml of N, N-dimethylformamide was stirred at room temperature in a nitrogen steam, while a solution containing 20.6 g of dicyclohexylcarbodiimide dissolved in 15 ml of N,N-dimethylformamide was dropwise added to the mixture over a 30 minute period. After the conclusion of the dropwise addition, the reaction mixture was cooled to room temperature after stirring at 80° C. for 8 hours. The precipitated N,N'-dicylohexylurea was removed by filtration, and to the filtrate was added 300 ml of ethyl acetate and washed with water for several times. The ethyl acetate solution was concentrated and then the oily residue was mixed with a mixed solvent of methanol and acetate to deposit 17.6 g of malonic acid bis-(2,5-diocyloxycarbonylanilide). Melting point 55°C.-56° C.

(d) Synthesis of Coupler Cp-(27)

5.9 g of bromine was added dropwise to 200 ml of a chloroform solution containing 30.8 g of the foregoing malonic acid bis-(2,5-dioctyloxycarbonylanilide) under an ice-cooled condition. The reaction mixture was washed with water and dried over potassium chloride. The resulting mixture was added dropwise to 100 ml of a chloroform solution containing 16.8 g of 5-phenoxycarbonyl-benzotriazole and 9.8 ml of triethylamine with stirring over a 1-hour period under an ice-cooled condition. After the conclusion of the addition, the reaction solution was stirred for 3 hours and to the solution 500 ml of ethyl acetate was added, and filtration and washing were conducted. The ethyl acetate solution was concentrated and to the residue a mixed solvent of n-hexane and ethyl acetate was added to remove an excess amount of precipitated 5-phenoxycarbonylbenzotriazole, and then concentrated again. The resulting residue was mixed with a mixed solvent of ethyl acetate and acetonitrile to deposit 16.7 g of the intended coupler Cp-(27). Melting Point 87° C.–88° C.

SYNTHESIS EXAMPLE 5

Syntheses of Coupler Cp-(29)

(a) Synthesis of Dodecyl 4-Methylthiophenyl Ether

A mixture of 50.9 g of 4-methylthiophenol, 125 g of potassium carbonate and 300 ml of N,N-dimethylformamide was heated and stirred in a nitrogen steam on a steam bath. And 90.5 g of 1-bromododecane was dropwise added to the mixture over a 1-hour period. After the conclusion of the addition, the reaction mixture was stirred for 3 hours and to the solution ethyl acetate was added, and filtration and washing were conducted. The ethyl acetate solution was concentrated and to the residue methanol was added to deposit 100 g of docecyl 4-methylthiophenyl ether white crystal.

(b) Synthesis of dodecyl 4-Methylsulfonylphenyl Ether 95.4 g of dodecyl 4-methylthiophenyl ether was dissolved in 400 ml of acetic acid, and further a dilute sodium hydroxide solution containing 0.5 g of sodium tangstate was added thereto. The resulting solution was heated at 80° C. with stirring. To the solution 66.3 g of 35% hydrogen peroxide was dropwise added. After the conclution of the addition, the reaction mixture was stirred for 2-hours under heating, and, after cooling, water was added to filtrate a precipitated crude crystal. The crude crystal was recrystalized by using methanol to obtain 101.5 g of dodecyl 4-methylsulfonylphenyl ether crystal.

(c) Synthesis of Dedecyl 4-Methylsulfonyl-2-Nitrophenyl Ether 29.4 g of dodecyl 4-methylsulfonylphenyl ether was dissolved in 100 ml of acetic acid anhydride, and 10 ml of sulfuric acid was dropwise added thereto under an ice-cooled condition, and further 6.4 g of 94% nitric acid was dropwise added thereto. After the conclusion of the addition, the resulting mixture was stirred for 1 hour and poured into an ice bath, followed by stirring. The precipitated crystal was filtrated out and recrystalized by using methanol to obtain 27.7 g of flaky light yellow crystal of dodecyl 4-methylsulfonyl-2-nitrophenyl ether.

(d) Synthesis of Dodecyl 2-Amino-4-Methylsulfonylphenyl Ether

A mixture of 25.2 g of iron powder, 1 g of ammonium chloride, 25 ml of water and 250 ml of isopropanol was heated and stirred in a nitrogen stream. To the mixture 23.1 g of dodecyl 4-methylsulfonyl-2-nitrophenyl ether was added. After the conclusion of the addition and a 1-hour stirring, the resulting solution was filtrated out by a Nusche coated sellaite therein. The reaction mixture was concentrated, and to the mixture methanol was added to deposit 17.5 g of dodecyl 2-amino-4-methylsulfonylphenyl ether crystal.

(e) Synthesis of Malonic Acid Di-(2-Dodecyloxy-5-Methylsulfonylanilide)

8 g of malonic acid di-(2-dodecyloxy-5-methylsulfonylanidide) was prepared from 17.5 g of dodecyl 2-amino-4-methylsulfonylphenyl ether and 2.44 g of malonic acid in the same manner as Synthesis Example 4 except for using methanol as a solvent. Melting Point 92° C.–94° C.

(f) Synthesis of Coupler Cp-(29)

9.2 g of the intended coupler Cp-(29) was prepared from 8 g of malonic acid di-(2-dodecyloxy-5-methylsulfonylanilide) in the same manner as Synthesis Example 4 except for using methanol as a solvent. Melting Point 159° C.–168° C.

When the couplers having the structures of the present invention are employed as DIR couplers, these DIR couplers may be incorporated into any constituent in a light-sensitive layer or in a light-insensitive layer. A preferred amount of the incorporated DIR coupler is from $1\times10^{-4}$ to 5 mol% to the total silver coverage, more preferably it is from $1\times10^{-3}$ mol%, and must preferably it is $1\times10^{-3}$ to 1 mol% to the total silver coverage.

Incorporation of these DIR couplers into sensitive materials can be effected by using known methods of adding or dispersing conventional couplers into emulsions, or conventional DIR couplers into gelatin-silver halide emulsions or hydrophilic colloids. For instance, dispersion methods which involve mixing couplers with high boiling organic solvents, including, e.g., dibutyl phthalate, tricresyl phosphate, waxes, higher fatty acids and their esters, etc.; methods as disclosed in U.S. Pat. Nos. 2,304,939 and 2,322,027, and so on; dispersion methods which involve mingling couplers with low boiling organic solvents or water-soluble organic solvents; methods which involve dispersing couplers by the combined use of high boiling organic solvents and low boiling or water-soluble ones; methods as disclosed, e.g., in U.S. Pat. Nos. 2,801,170, 2,801,171 and 2,949,360; methods which are applicable when couplers themselves have sufficiently low boiling points (e.g., below 75° C.), and involve dispersing the couplers independently or in combination with other couplers to be used together, which may be colored or uncolored; and methods as disclosed, e.g., in West German Patent 1,143,707 can be applied to the present invention.

Suitable examples of dispersion aids which can be used include generally used anionic surface active agents (e.g., sodium alkylbenzenesulfonates, sodium dioctylsulfosuccinate, sodium dodecylsulfate, sodium alkylnaphthalenesulfonates, Fischer type couplers), amphoteric surface active agents (e.g., N-tetradecylN,N-dipoethylene α-betaine) and nonionic surface active agents (e.g., sorbitol, monolaurates).

Preferred silver halides to be contained in photographic emulsion layers of photographic light-sensitive materials which can be used in the present invention include silver iodobromide, silver iodochloride and silver iodochlorobromide, wherein the iodide content is up to about 30 mol%. In particular, silver iodobromides containing silver iodide in a fraction of from about 2 mol% to about 25 mol% are favored over others.

The silver halide grains in the photographic emulsions may have a regular crystal form, such as that of a cube, an octahedron, a tetradecahedron or so on, an irregular crystal form, such as that of a sphere, a plate or so on, a form having crystal defects such as twinning planes, or a composite form of these various crystal forms.

The silver halides may be fine grains having a size of about 0.2 micron or less, or coarse ones having a projected area diameter of up to about 10 microns, and may have any kind of size distribution, polydisperse or monodisperse.

Silver halide photographic emulsions which can be used in the present invention can be prepared using methods as described, e.g., in *Research Disclosure* (RD), No. 17643, pp. 22–23, entitled "I. Emulsion Preparation and Types" (Dec. 1978), and Supra, No. 18716, p. 648 (Nov. 1979); P. Glafkides, *Chimie et Physique Photoqraghique*, Paul Montel (1967); G.F. Duffin, *Photographic Emulsion Chemistry*, Focal Press (1966); V.L. Zelikman et al., *Making and Coating Photographic Emulsion*, Focal Press (1964); and so on.

The monodisperse emulsions disclosed in U.S. Pat. Nos. 3,574,628 and 3,655,394, and British Patent 1,413,748 are also preferably used.

In addition, tabular grains having an aspect ratio of about 5 or above can be used in the present invention. The tabular grains can be prepared with ease using methods as described in Gutoff, *Photographic Science and Engineering*, vol. 14, pp. 248–257 (1970), U.S. Pat. Nos. 4,434,226, 4,414,310, 4,433,048 and 4,439,520, British Patent 2,112,157, and so on.

The crystal structure of the grains may be uniform throughout, or the interior and the surface of the silver halide grains may differ in halogen composition, or the grains may have a layer structure, or silver halides differing in composition may be joined together by the epitaxial junction, or the grains may be joined with a compound other than silver halides, e.g., silver thiocyanide, lead oxide, etc.

Also, a mixture of silver halide grains having various crystal forms may be used.

Silver halide emulsions to be used are generally ripened physically and chemically, and further sensitized spectrally. Additives to be used in these steps are described in *Research Disclosure*, No. 17643 and No. 18716, and the columns in which descriptions thereof are given are set forth together in the following table.

Photographic additives which can be used in the present invention are also described in the above-described two literature publications, and where they are described are also tabulated in the following table.

| Additives | RD 17643 | RD 18716 |
|---|---|---|
| 1. Chemical sensitizers | p. 23 | p. 648, right column |
| 2. Sensitivity-increasing agents | | " |

-continued

| Additives | RD 17643 | RD 18716 |
|---|---|---|
| 3. Spectral sensitizers and supersensitizers | p. 23–24 | p. 648, right column to p. 649, right column |
| 4. Brightening agents | p. 24 | |
| 5. Antifoggant and stabilizers | p. 24–25 | p. 649, right column |
| 6. Light absorbents, filter dyes, and UV-ray absorbents | p. 25–26 | p. 649, right column to p. 650, left column |
| 7. Stain inhibitor | p. 25, right column | p. 650, left column to right column |
| 8. Dye image-stabilizing agents | p. 25 | |
| 9. Hardeners | p. 26 | p.651, left column |
| 10. Binders | p. 26 | " |
| 11. Plasticizers and Lubricants | p. 27 | p. 650, right column |
| 12. Coating aids and surface active agents | p. 26–27 | " |
| 13. Antistatic agents | p. 27 | " |

Various color couplers can be used in the present invention, and specific examples thereof are described in the foregoing in *Research Disclosure*, No. 17643, Item VII-C to VII-G.

Preferred yellow couplers are those disclosed, e.g., in U.S. Pat. Nos. 3,933,501, 4,022,620, 4,326,024 and 4,401,752, JP-B-58-10739 (The term "JP-B" as used herein means an "examined Japanese patent publication"), British Patents 1,425,020 and 1,476,760, and so on.

Preferred magenta couplers are those of 5-pyrazolone and pyrazoloazole types, especially those disclosed in U.S. Pat. Nos. 4,310,619 and 4,351,897, European Patent 73,636, U.S. Pat. Nos. 3,061,432 and 3,725,067, *Research Disclosure* No. 24220 (Jun. 1984), JP-A-60-33552, *Research Disclosure* No. 24230 (Jun. 1984), JP-A-60-43659, JP-A-60-43659, and U.S. Pat. Nos. 4,500,630 and 4,540,654.

Cyan couplers include those of phenol and naphthol types, and preferred examples thereof are those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-0121365, U.S. Pat. Nos. 3,446,622, 4,333,999, 4,451,559 and 4,427,767, EP-A-0161,626, and so on.

As for the colored couplers to be used for compensating unnecessary absorptions of color-developed dyes, those disclosed in *Research Disclosure*, No. 17643, Item VII-G, U.S. Pat. No. 4,163,670, JP-B-57-39413, U.S. Pat. Nos. 4,004,929 and 4,138,258, and British Patent 1,146,368 are preferably used.

As for the couplers which can produce color-developed dyes having moderate diffusibility, those disclosed in U.S. Pat. No. 4,366,237, British Patent 2,125,570, European Patent 96,570, and West German Patent Application (OLS]No. 3,234,533 are preferably used.

Typical examples of polymeric dye-forming couplers are described in U.S. Pat. Nos. 3,451,820, 4,080,211 and 4,367,282, British Patent 2,102,173, and so on.

Couplers capable of releasing photographically useful residues upon coupling can also be used to advantage in the present invention. For instance, preferred DIR couplers, or couplers capable of releasing development inhibitors, include those disclosed in the patents cited in *Research Disclosure,* No. 17643, Item VII-F, JP-A-57-151944, JP-A-57-154234, JP-A-60-184248, and U.S. Pat. No. 4,248,962.

As for the couplers capable of releasing imagewise a nucleating agent or a development accelerator upon development, those disclosed in British Patents 2,097,140 and 2,131,188, JP-A-59-157638 and JP-A-59-170840 are preferably used.

In addition, competing couplers as disclosed in U.S. Pat. No. 4,130,427; polyequivalent couplers as disclosed in U.S. Pat. Nos. 4,283,472, 4,338,393 and 4,310,618; DIR redox compound or DIR coupler-releasing couplers and DIR coupler releasing, coupler or redox compounds, as disclosed in JP-A-60-18590 and JP-A-62-24252; the couplers releasing dyes capable of recovering their colors after elimination, disclosed in EP-A-0173302; bleach accelerator-releasing couplers as described in RD No. 11449, RD No. 24241, and JP-A-61-201247; and ligand-releasing couplers as described in U.S. Pat. No. 4,553,477 are cited as examples of couplers which can be used in the present invention.

Specific examples of color couplers which can be used in the present invention are illustrated below. However, the invention should not be construed as being limited to these examples.

C-(1)

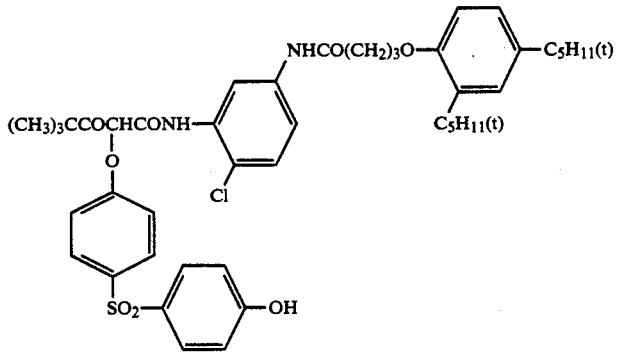

C-(2)

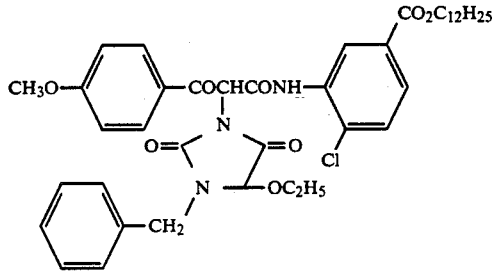

C-(3)

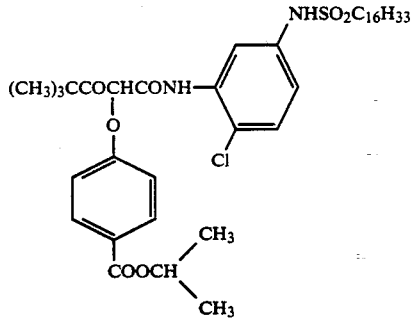

C-(4)

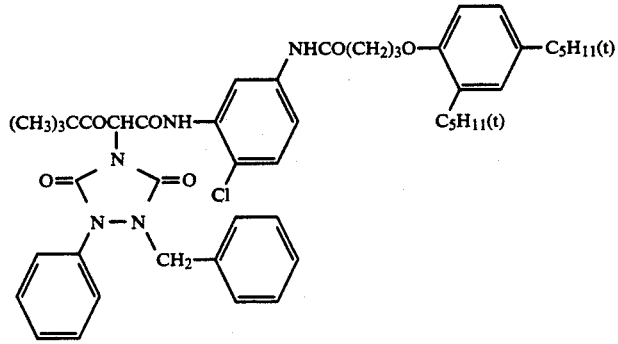

-continued
C-(5)
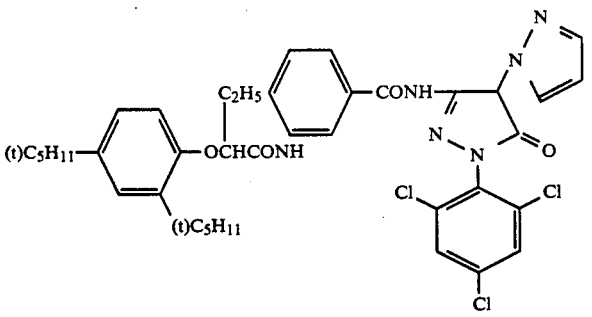
C-(6)
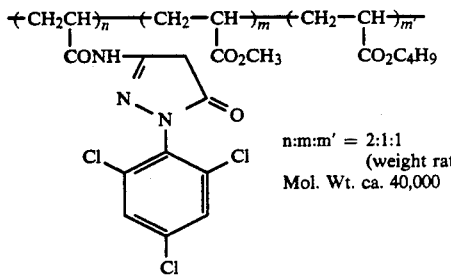
n:m:m' = 2:1:1
(weight ratio)
Mol. Wt. ca. 40,000
C-(7)
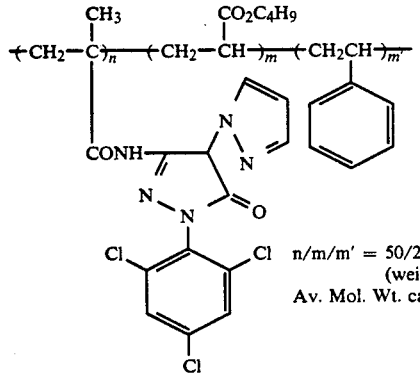
n/m/m' = 50/25/25
(weight ratio %)
Av. Mol. Wt. ca. 30,000
C-(8)
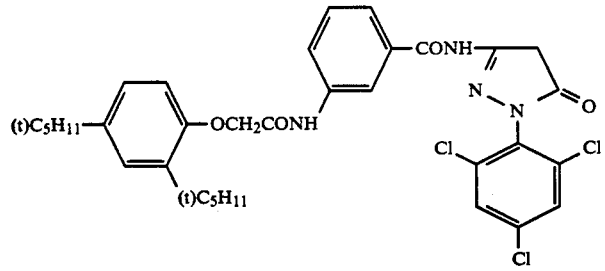
C-(9)
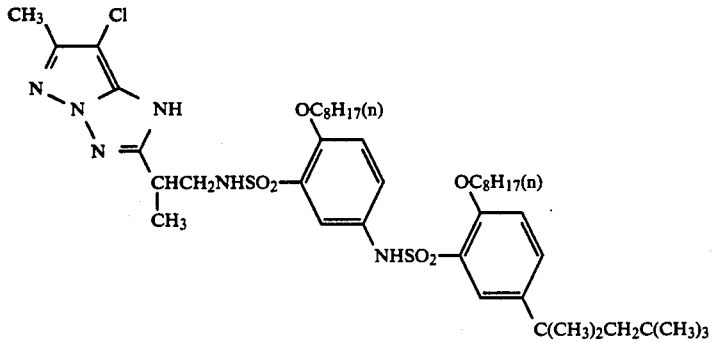

-continued
C-(10)
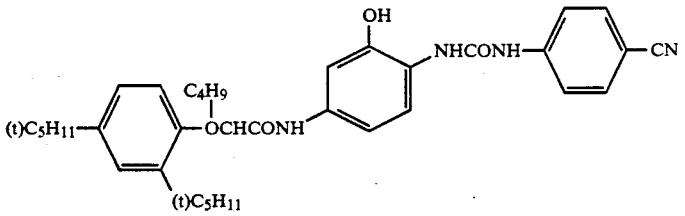
C-(11)
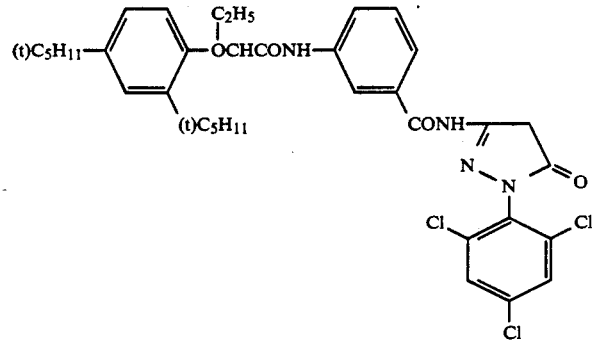
C-(12)
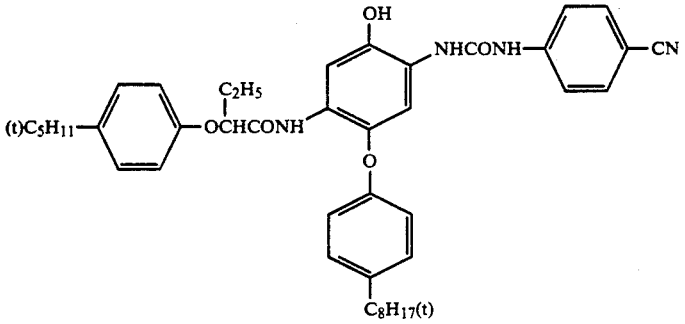
C-(13)
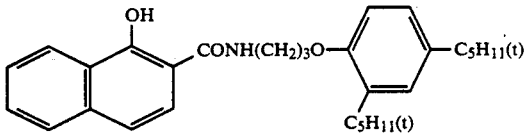
C-(14)
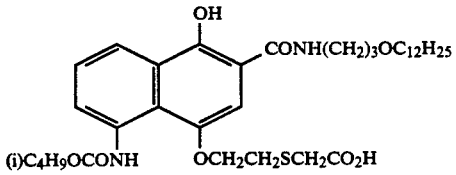
C-(15)
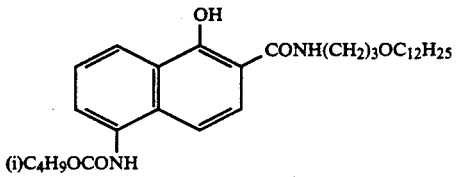

-continued
C-(16)
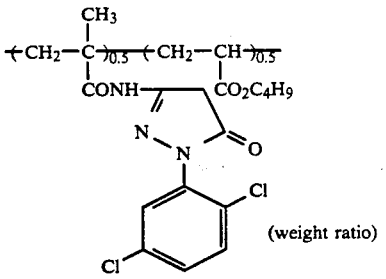
C-(17)
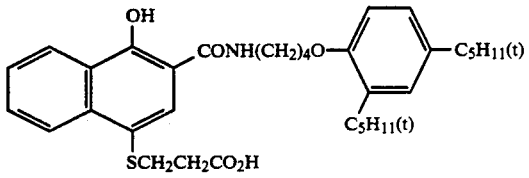
C-(18)
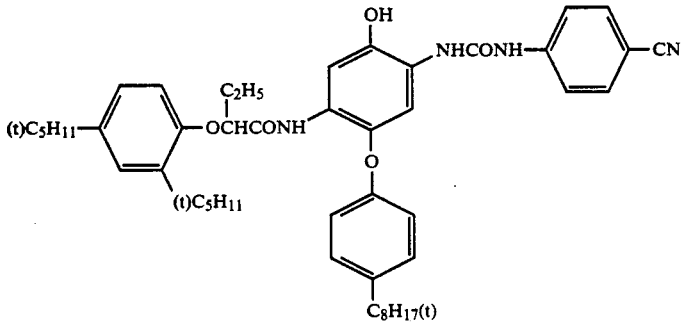
C-(19)
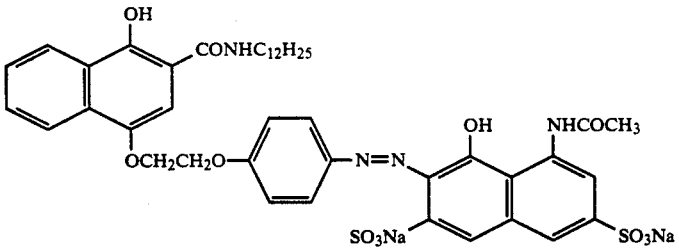
C-(20)
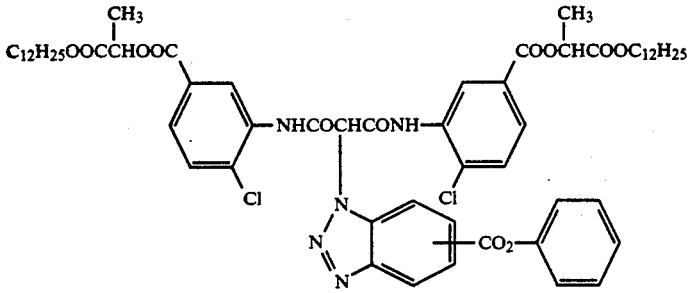

-continued
C-(21)
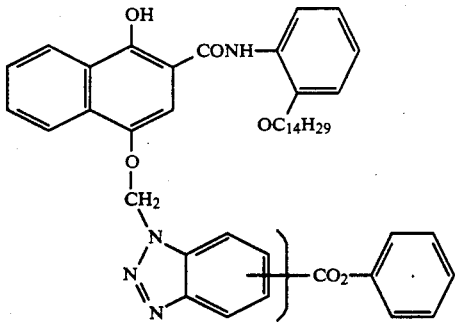
C-(22)
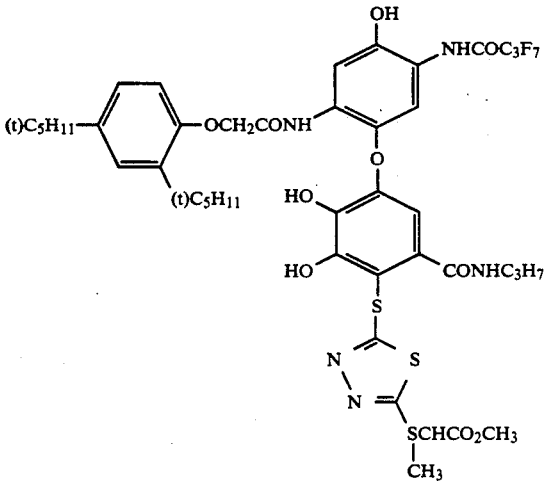
C-(23)
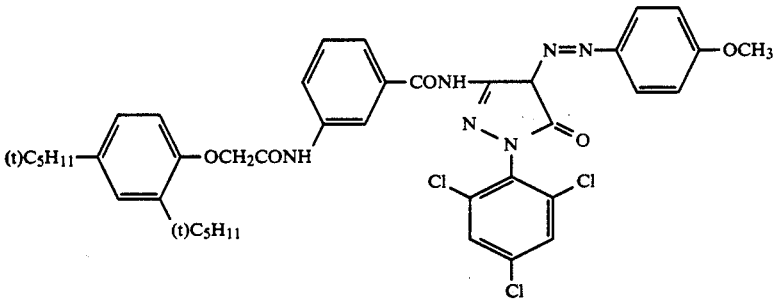
C-(24)
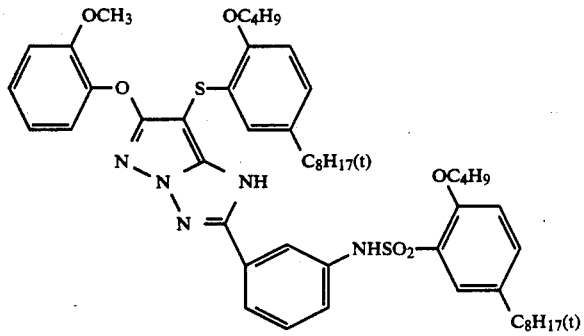

-continued
C-(25)
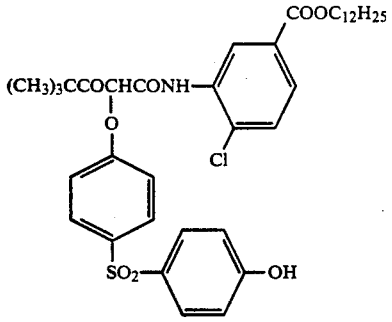
C-(26)
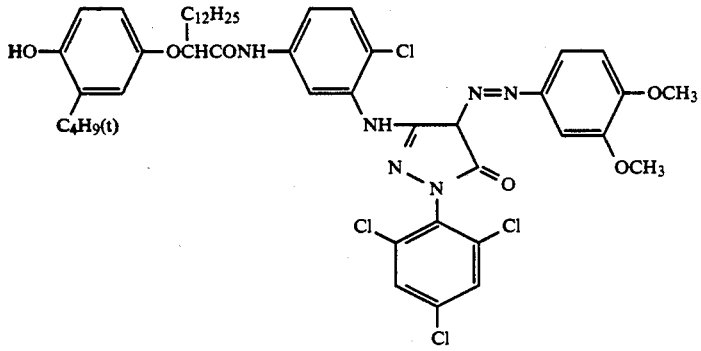
C-(27)
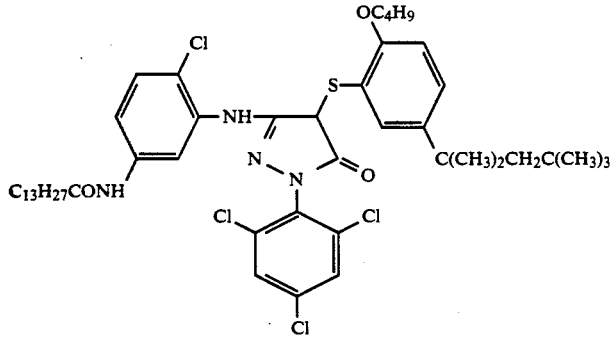
C-(28)
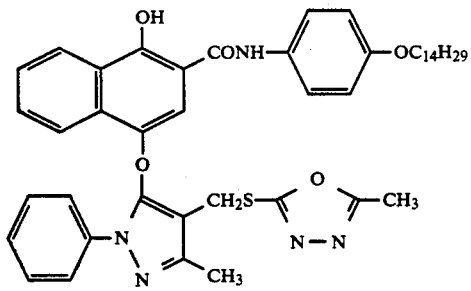
C-(29)
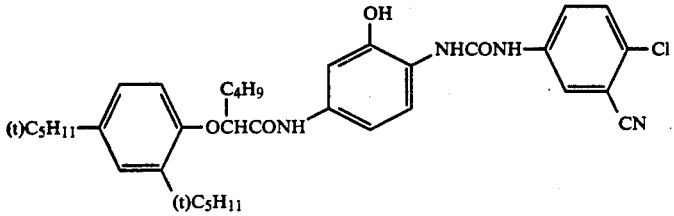

-continued
C-(30)
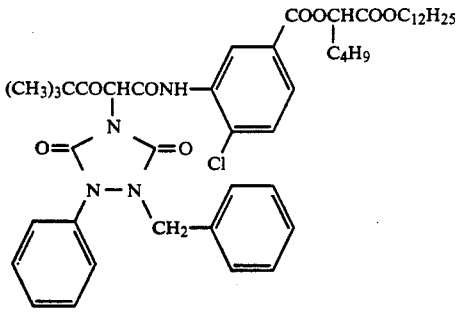
C-(31)
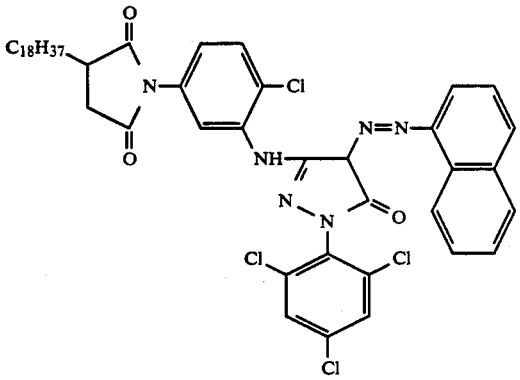
C-(32)
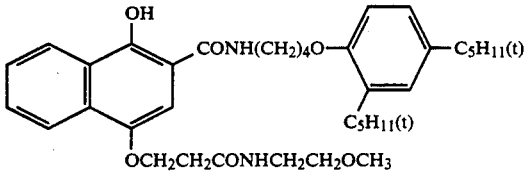
C-(33)
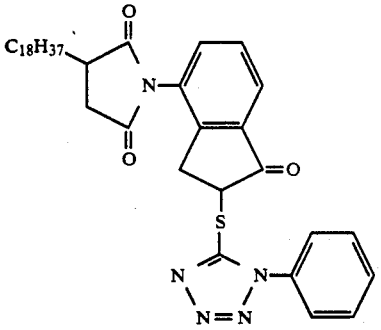
C-(34)
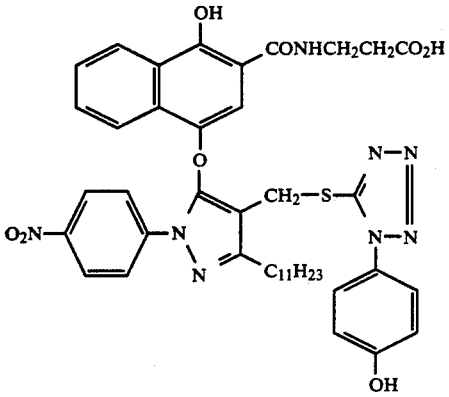

-continued
C-(35)
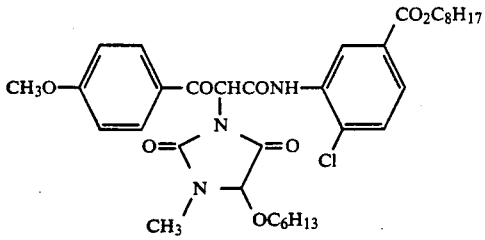
C-(36)
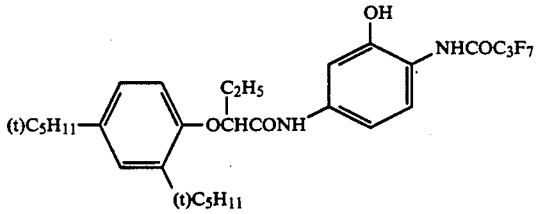
C-(37)
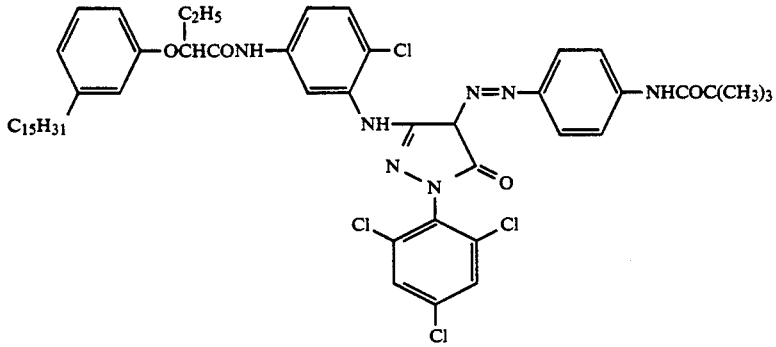
C-(38)
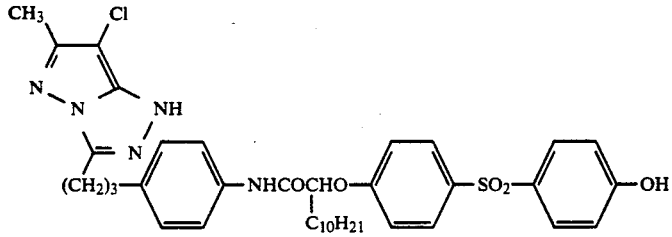
C-(39)
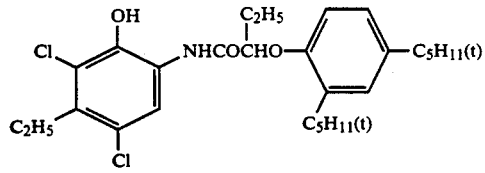
C-(40)
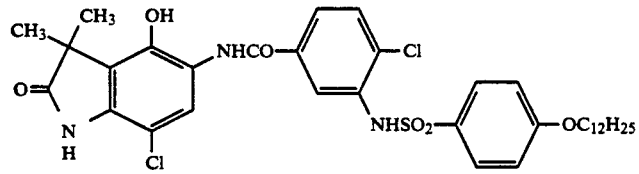
C-(41)
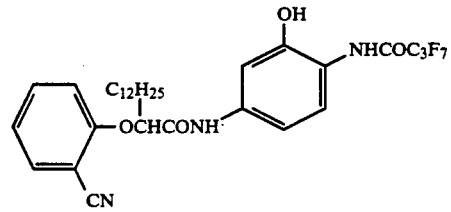

-continued
C-(42)
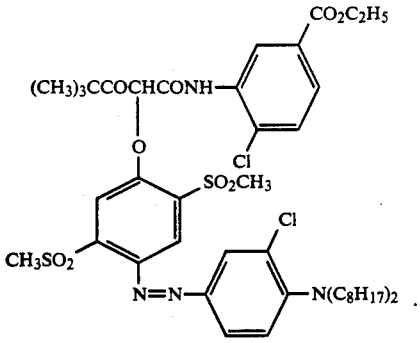
C-(43)
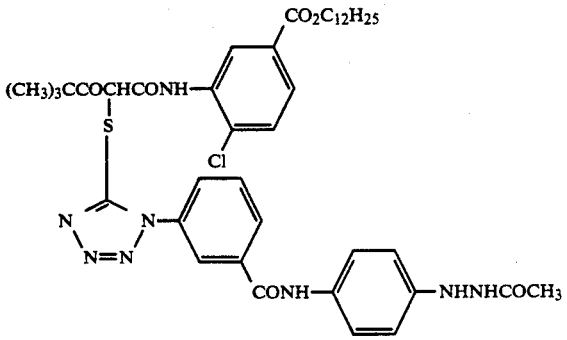
C-(44)
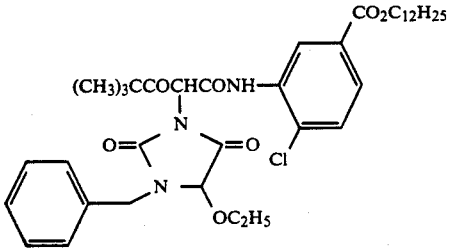
C-(45)
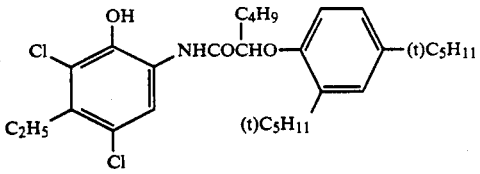
C-(46)
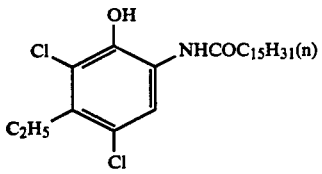
C-(47)
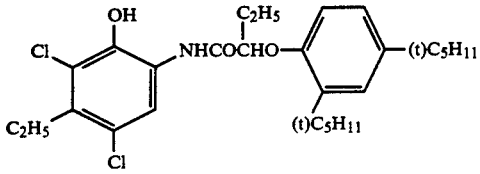

-continued
C-(48)
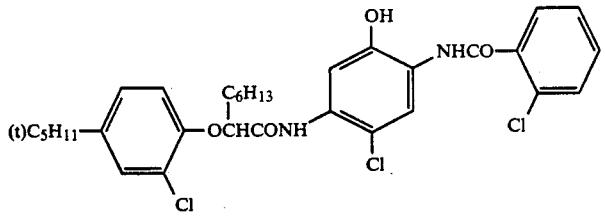
C-(49)
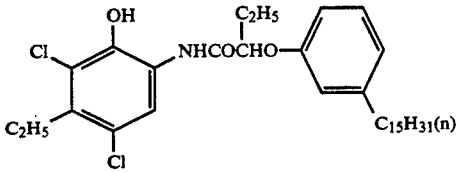
C-(50)
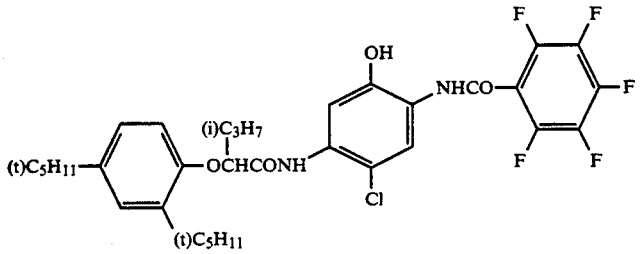
C-(51)
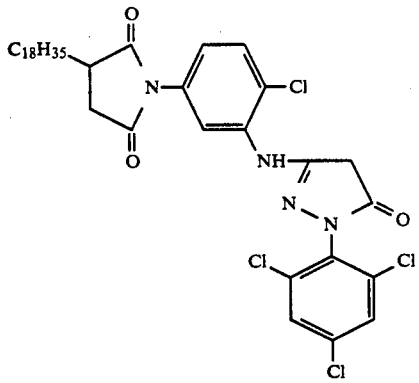
C-(52)
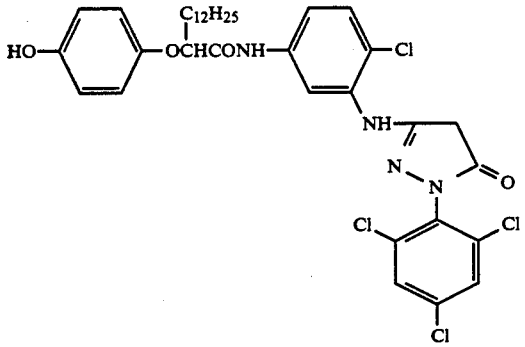

-continued
C-(53)
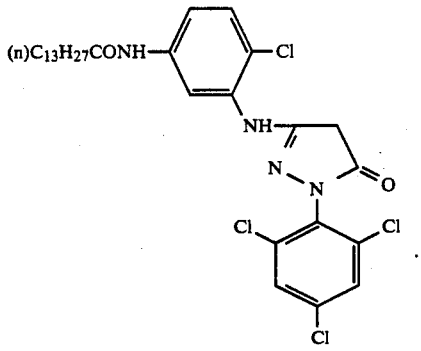
C-(54)
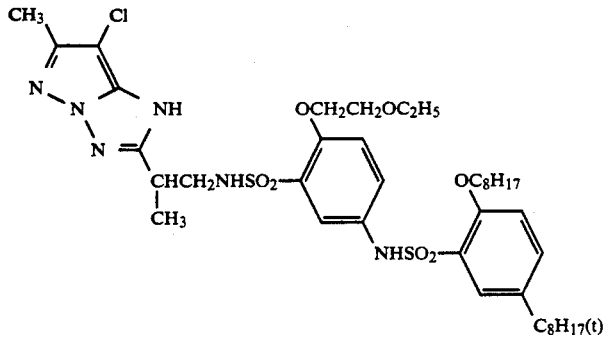
C-(55)
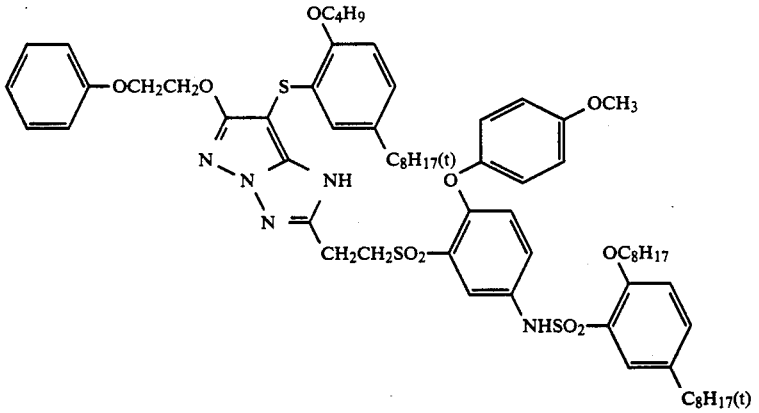
C-(56)
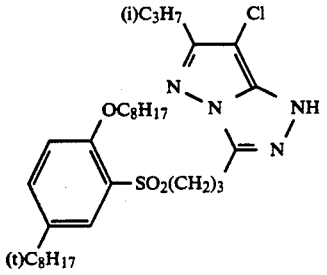

-continued
C-(57)
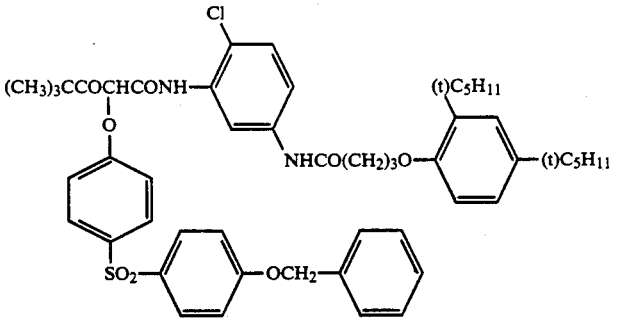
C-(58)
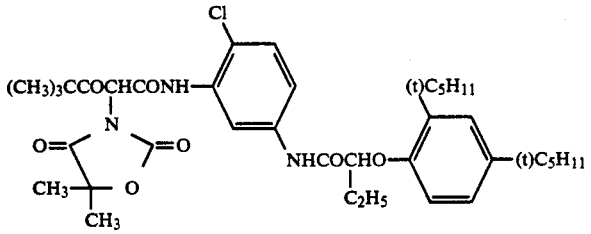
C-(59)
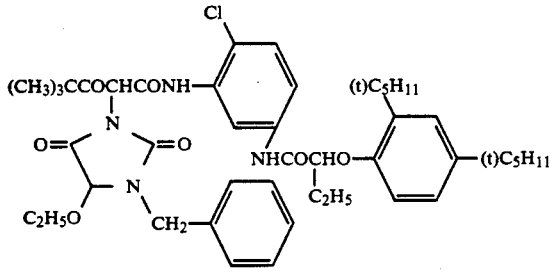
C-(60)
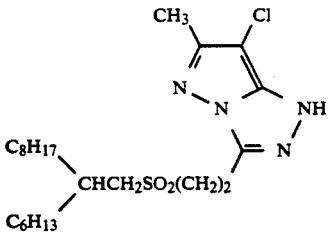
C-(61)
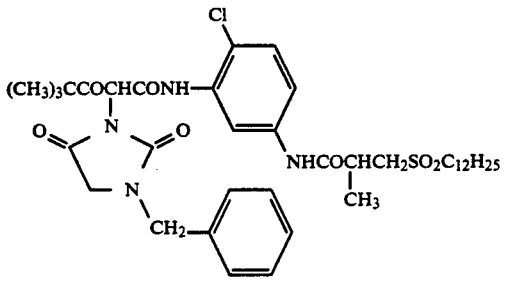

-continued

C-(62)

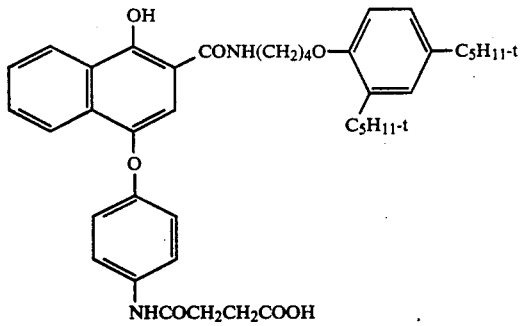

Couplers to be used in the present invention are introduced into sensitive materials according to known dispersion methods.

High boiling solvents which can be used in oil-in-water dispersion methods are described, e.g., in U.S. Pat. No. 2,322,027.

Specific examples of high boiling organic solvents having a boiling point of 175° C. or above at ordinary pressure, which can be used in the oil-in-water dispersion methods, include phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl) phthalate), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate), benzoic acid esters (e.g., 2-ethylhexylbenzoate, dodecylbenzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl)sebacate, dioctyl azelate, glycerol tributyrate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene), and so on. In addition, organic solvents having a boiling point ranging from about 30° C., preferably 50° C., to about 160° C. can be used as auxiliary solvents. Typical examples of such solvents include ethyl acetate, butyl acetate, ethyl propionate, methyl ethyl ketone, cyclohexanone, 2-ethoxyethyl acetate, dimethylformamide, and so on.

Processes of latex dispersion methods, their effects and specific examples of latexes for impregnant use are described, e.g., in U.S. Pat. No. 4,199,363, West German Application (OLS) Nos. 2,541,274 and 2,541,230, and so on.

The present invention can be applied to various kinds of color photosensitive materials. As typical representatives of such materials, mention may be made of color negative films for amateur or motion picture use, color reversal films for slide or television use, color paper, color positive films and color reversal paper.

Suitable supports which can be used in the present invention are described, e.g., in the foregoing RD No. 17643, p. 28, and RD No. 18716, from the right column on page 647 to the left column on page 648.

The color photographic light-sensitive materials produced in accordance with the present invention can be developed using general methods described in the foregoing RD No. 17643, pages 28 and 29, and RD No. 18716, from the left to the right column on page 651.

A color developer which can be used for the development processing of the photosensitive material of the present invention is preferably an alkaline aqueous solution containing as a main component a developing agent of aromatic primary amine type. Though aminophenol compounds are also useful as a color developing agent, p-phenylenediamine compounds are preferred herein. As representative examples of phenylenediamine compounds, mention may be made of 3-methyl-4-amino-N,Ndiethylaniline, 3-methyl-4-amino-N-ethyl-N-β-hydroxyaniline, 3-methyl-4-amino-N-ethyl-N-β-methanesulfonamidoethylaniline, 3-methyl-4-amino-N-ethyl-N-β-methoxyethylaniline, and the sulfates, hydrochlorides or p-toluenesulfonates of these anilines. These compounds can be used as a mixture of two or more thereof depending on the intended use.

In addition, the color developer generally contains pH buffering agents such as carbonates, borates or phosphates of alkali metals, and development inhibitors or antifoggants, such as bromides, iodides, benzimidazoles, benzothiazoles or mercapto compounds. Further, it can optionally contain various kinds of preservatives, such as hydroxylamine, diethylhydroxylamine, sulfites, hydrazines, phenylsemicarbazides, triethanolamine, catechol sulfonic acids, and triethylenediamine(1,4-diazabicyclo[2,2,2]octane); organic solvents, such as ethylene glycol, and diethylene glycol; development accelerators, such as benzyl alcohol, polyethylene glycol, quaternary ammonium salts and amines; dye-forming couplers; competing couplers; fogging agents such as sodium borohydride; auxiliary developers such as 1-phenyl-3-pyrazolidone; viscosity imparting agents; chelating agents as represented by aminopolycarboxylic acids, aminopolyphosphonic acids, alkylphosphonic acids, and phosphonocarboxylic acids, with specific examples including ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In case of the reversal processing, color development is generally carried out subsequently to black and white development. Black and white developers which can be used therein can contain known black and white developing agents, e.g., dihydroxybenzenes such as hydroquinone, 3-pyrazolidones such as 1-phenyl-3-pyrazolidone, aminophenols such as N-methyl-p-aminophenol, and so on, independently or in combination of two or more thereof.

In general, the pH of such a color developer or a black and white developer as described above is from 9 to 12.

Amounts of replenishers to be added to the foregoing developers, although dependant on the chosen color photographic material, are generally not more than 3 liter per square meter of the photographic material. When a replenisher having a reduced bromide ion concentration is used, the replenishing amount can be even reduced to below 500 ml. In using a reduced amount of replenisher, it is to be desired that evaporation and aerial oxidation of the developer should be prevented by diminishing the contact area of the processing tank with the atmosphere. Also, reduction in the amount of replenisher to be added can be achieved by employing means of suppressing an accumulation of bromide ion in the developer.

After color development, the photographic emulsion layers are generally subjected to a bleach processing. The bleach processing may be carried out simultaneously with a fixation processing (a bleach-fix processing), or separately therefrom. For the purpose of speedup of the photograhic processing, the bleach processing may be succeeded by the bleach-fix processing. Also, the processing may be performed with two successive bleach-fix baths, or the fixation processing may be succeeded by the bleach-fix processing, or the bleach-fix processing may be succeeded by the bleach processing, if desired. Examples of bleaching agents which can be used include compounds of polyvalent metals, such as Fe(III), Co(III), Cr(VI), Cu(II), etc.; peroxy acids; quinones; nitro compounds; and so on. More specifically, ferricyanides; dichromates; organic complex salts formed by Fe(III) or Co(III), and aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diamine tetraacetic acid, etc., citric acid, tartaric acid, malic acid, or so on; persulfates; hydrobromides; permanganates; nitrobenzenes; and so on can be cited as representative bleaching agents. Of these bleaching agents, aminopolycarboxylic acid-Fe(III) complex salts including (ethylenediaminetetraacetato) iron(III) complex, and persulfates are preferred over others in respects of rapid processing and prevention of environmental pollution. In particular, aminopolycarboxylic acid-Fe(III) complex salts are useful in both the bleaching bath and bleach-fix bath. The pH of the bleaching or bleach-fix bath which uses an aminopolycarboxylic acid-Fe(III) complex salt as a bleaching agent generally is from 5.5 to 8, but the processing can be performed at lower pH for the purpose of increasing the processing speed.

In the bleaching bath, the bleach-fix bath and prebaths thereof, bleach accelerators can be used, if needed. Specific examples of useful bleach accelerators include compounds having a mercapto group or a disulfide linkage as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-10423, JP-A-53-12424, JP-A-53-141623, JP-A-53-28426, *Research Disclosure* No. 17129 (Jul. 1978), and so on; thiazolidine derivatives as described in JP-A-50-140129; thiourea derivatives as described in JP-B-45-8506, JP-A-52-20832, JP-A-53-32735, and U.S. Pat. No. 3,706,561; iodides described in West German Patent 1,127,715 and JP-A-58-16235; polyoxyethylene compounds described in West German Patents 966,410 and 2,748,430; polyamine compounds described in JP-B-45-8836; the compounds described in JP-A-49-42434, JP-A-49-59644, JP-A-53-94927, JP-A-54-35727, JP-A-55-26506 and JP-A-58-163940; bromide ion; and so on. Of these bleach accelerators, compounds having a mercapto group or a disulfide linkage are preferred over others because of their great effect upon bleach acceleration. In particular, the compounds described in U.S. Pat. No. 3,893,858, West German Patent 1,290,812 and JP-A-53-95630 are effective. In addition, the compounds described in U.S. Pat. No. 4,552,834 are favored. These bleach accelerators may be incorporated in the photosensitive material. When a color photosensitive material for photograph-taking is subjected to a bleachfix processing, these bleach accelerators can have a particularly great effect.

As examples of fixers which can be used, mention may be made of thiosulfates, thiocyanates, thioether compounds, thioureas, a large amount of iodide, and so on. Of these fixers, generally used ones are thiosulfates, especially ammonium thiosulfate. As for the preservatives for a bleach-fix bath, sulfites, bisulfites or adducts of carbonyl compounds and bisulfite are preferably used.

After a desilvering step, the silver halide color photographic material of the present invention is, in general, subjected to a washing step and/or a stabilizing step. A volume of washing water required can be determined variously depending on the characteristics of photosensitive materials to be processed, (depending, e.g., on what kinds of couplers are incorporated therein), end-use purposes of photosensitive materials to be processed, the temperature of washing water, the number of washing tanks (stage number), the way of replenishing washing water (as to, e.g., whether a current of water flows in the counter direction, or not), and other various conditions, of these conditions, the relation between the number of washing tanks and the volume of washing water in the multistage countercurrent process can be determined according to the methods described in *Journal of the Society of Motion Picture and Television Engineers*, volume 64, pages 248–253 (May 1955).

According to the multistage countercurrent process described in the above-cited literature, a volume of washing water can be sharply decreased. However, the process has disadvantages, e.g., in that bacteria propagate themselves in the tanks because of an increase in staying time of water in the tanks, and suspended matter produced from the bacteria sticks to photosensitive materials processed therein. As the means of solving such problems which can occur in the processing of the color photosensitive material of the present invention when the above-described process is applied, the method of reducing the amounts of calcium and magnesium, which is described in JP-A-62-288838, can be used to great advantage. Further, bactericides such as isothiazolone compounds and thiabendazoles described in JP-A-57-8542, chlorine-containing germicides such as the sodium salt of chlorinated isocyanuric acid, and benzotriazoles as described in Hiroshi Horiguchi *Bohkin Bohbai Zai no Kagaku* (which means "chemistry of antibacteria and antimolds"), *Biseibutsu no Mekkin Sakkin Bohbe Gijutsu* (which means "Arts of sterilizing and pasteurizing microbe, and proofing against mold"), compiled by Eisei Gijutsu Kai, and *Bohkin- and Bohbaizai Jiten* (which means "Theseaurus of antibacteria and antimolds"), compiled by Nippon Bohkin Bohbai Gakkai.

Washing water to be used in the processing of the photosensitive material of the present invention is adjusted to a pH of 4 to 9, preferably to a pH of 5 to 8. The washing temperature and washing time, though can be chosen variously depending on the characteristics and the intended use of the photosensitive material to be washed, and are generally chosen from the range of 20 sec. to 10 min. at 15°–45° C., preferably the range of 30 sec to 5 min. at 25°–40° C.

Also, the photosensitive material of the present invention can be processed directly with a stabilizing bath in the place of using the above-described washing water. All known methods, such as those described in JP-A-57-8543, JP-A-58-14834 and JP-A-60-220345, can be applied to the stabilization processing in the present invention.

In some cases, the above-described washing processing may be succeeded by the stabilization processing. As an example of the stabilizing bath, a bath containing formaldehyde and a surface active agent, which has so far been used as the final bath in the photographic processing of color photosensitive materials for photograph-taking use can be cited.

To the stabilizing bath also, various kinds of chelating agents and antimolds can be added.

The washing water and/or the stabilizing solution which overflows the processing baths as a result of the replenishing thereof can also be reused in other steps such as the desilvering step.

For the purposes of simplification and speedup of photographic processing of the silver halide photosensitive material to be used in the present invention, a color developing agent may be incorporated thereinto. Therein, it is desirable that the color developing agent should be used in the form of precursors of various types. For instance, compounds of an indoaniline type described in U.S. Pat. No. 3,342,597, compounds of Schiff base type described in U.S. Pat. No. 3,342,599 and Research Disclosure (RD), Nos. 14850 and 15159, aldol compounds described in RD, No. 13924, metal complex salts described in U.S. Pat. No. 3,719,492, and compounds of urethane type described in JP-A-53-135628 can be cited.

In the silver halide photosensitive material to be used in the present invention, various 1-phenyl-3-pyrazolidones may be incorporated for the purpose of accelerating color development. Typical examples of such compounds are described in JP-A-56-64339, JP-A-57-144547 and JP-A-58-115438.

The temperature of each processing bath used in the present invention ranges from 10° C. to 50° C. Though a standard temperature is within the range of 33° to 38° C., temperatures higher than standard one can be adopted for reduction of processing time through acceleration of the processing, while those lower than standard ones can enable the achievements of improved image quality and enhanced stability of the processing bath. Further, a processing utilizing a cobalt or hydrogen peroxide intensification method as described in West German Patent 2,226,770 or U.S. Pat. No. 3,674,499 may be carried out for the purpose of saving silver.

Moreover, the silver halide light-sensitive materials of the present invention can be applied to heat developable photosensitive materials as disclosed in U.S. Pat. No. 4,500,626, JP-A-60-133449, JP-A-59-218443, JP-A-61-238056, EP-A-0210660, and so on.

The present invention will now be described in greater detail by reference to the following examples. However, the invention should not be construed as being limited to these examples.

EXAMPLE 1

On a cellulose triacetate film support provided with a subbing layer, were coated two layers described below in this order to prepare a color photosensitive material (Sample 101).

For expressing coverages, g/m$^2$ based on silver was used in case of the silver halide emulsion and g/m$^2$ in cases of the couplers, the additives and gelatin.

| | |
|---|---|
| First Layer | |
| Silver iodobromide emulsion (AgI: 4.5 mol %) | 0.45 |
| Gelatin | 1.60 |
| ExC-17 | 0.45 |
| ExY-13 | 1.00 |
| Solv-1 | 0.20 |
| Second Layer | |
| Gelatin | 0.45 |
| Polymethylmethacrylate particle (diameter: 1.5 microns) | 0.2 |
| H-1 | 0.4 |

Preparation of Samples 102 and 103

Samples 102 and 103 were prepared in the same manner as Sample 101, except the couplers ExCp-16 and Cp-(3) as set forth in Table 1 were used in the place of ExY-13 in the same molar amount as ExY-13, respectively.

(the coupler disclosed in French Patent 1,558,452) ExCp-16

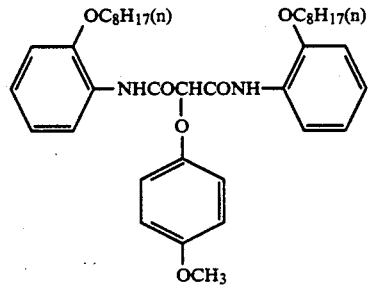

-continued

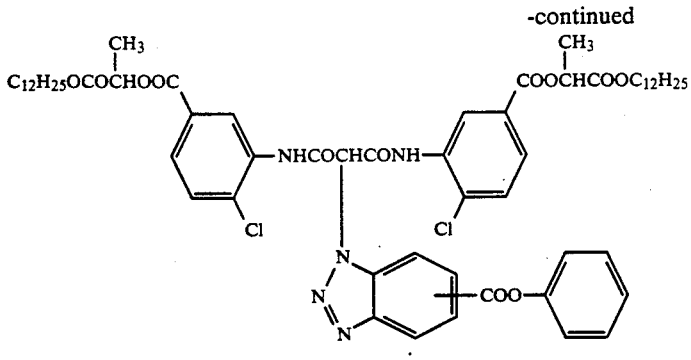

ExY-13

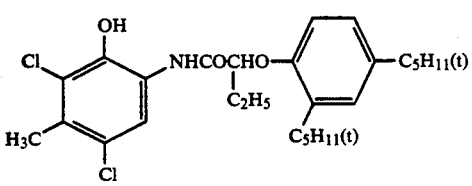

ExC-17

Preparation of Sample 104

Sample 104 was prepared in the same manner as Sample 101, except ExY-13 was excluded.

Preparation of Sample 151

Sample 151 was prepared in the same manner as Sample 101, except ExC-17 was excluded.

Preparation of Samples 152 and 153

Samples 152 and 153 were prepared in the same manner as Sample 151, except the couplers ExCp-16 and Cp-(3) as set forth in Table 1 were used in the place of ExY-13 in amounts equimolar with ExY-13, respectively.

Reactivity of each coupler was determined as follows: each of Samples 101 to 104 was wedgewise exposed, processed in accordance with the process described below, and examined for yellow densities ($D_B$) under various cyan densities ($D_R$). The reactivity was evaluated from the slope of the $D_R$ vs. $D_B$ plots. Yellow component densities of the cyan dyes were corrected using Sample 104.

The thus prepared samples were wedgewise exposed, and then processed in accordance with the process described below.

Processing Process

| Step | Processing Time | Processing Temperature |
|---|---|---|
| Color Development | 3 min. 15 sec. | 38° C. |
| Bleaching | 1 min. 00 sec. | 38° C. |
| Bleach-Fix | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

Compositions of the processing solutions used are described below.

| Color Developer | |
|---|---|
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |

-continued

| | |
|---|---|
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 l |
| pH | 10.05 |
| Bleaching Bath | |
| Ammonium ethylenediaminetetraacetato-ferrate(III) dihydrate | 120.0 g |
| Disodium ethylenediaminetetraacetate | 10.0 g |
| Ammonium bromide | 100.0 g |
| Ammonium nitrate | 10.0 g |
| Bleach accelerator | 0.005 mol |

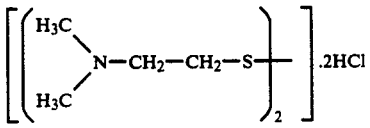

| | |
|---|---|
| Aqueous ammonia (27%) | 15.0 ml |
| Water to make | 1.0 l |
| pH | 6.3 |
| Bleach-Fix Bath | |
| Ammonium ethylenediaminetetraacetato-ferrate(III) dihydrate | 50.0 g |
| Disodium ethylenediaminetetraacetate | 5.0 g |
| Sodium sulfite | 12.0 |
| Aqueous solution of ammonium thio-sulfate (70%) | 240.0 ml |
| Aqueous ammonia (27%) | 6.0 ml |
| Water to make | 1.0 l |
| pH | 7.2 |

Washing Solution

City water was purified by passing it through a mixed-bed column packed with a strongly acidic H-type cation exchange resin (Amberlite IR-120B, produced by Rohm & Haas Co.) and an OH-type anion exchange resin (Amberlite IR-400, produced by Rohm & Haas, Co.) till calcium and magnesium ion concentrations were each reduced to 3 mg/λ or less, and then adding thereto 20 mg/λ of sodium dichloroisocyanurate and 150 mg/λ of sodium sulfate. The pH of the resulting water solution was within the range of 6.5 to 7.5.

| Stabilizing Solution | |
|---|---|
| Formaldehyde (37%) | 2.0 ml |
| Polyoxyethylene-p-monononylphenyl ether (mean polymerization degree: 10) | 0.3 g |
| Disodium ethylenediaminetetraacetate | 0.05 g |
| Water to make | 1.0 l |
| pH | 5.0–8.0 |

In order to examine the thus processed samples in their individual dye image-keeping qualities, one strip of each sample was allowed to stand in the dark for 24 hours at 60° C., 70% RH (relative humidity), and another strip was exposed to a xenon light source (200,000 lux) for 24 hours, and thereby dark discoloration and photodiscoloration were evaluated.

TABLE 1

| Sample No. | Couple | Reactivity of Coupler* | Dark discoloration** | Photodiscoloration*** |
|---|---|---|---|---|
| 101, 151 | ExY-13 (Comparison) | 9.0 | 0.21 | 0.38 |
| 102, 152 | ExCp-16 (Comparison) | 0.16 | 0.78 | 0.71 |
| 103, 153 | Cp-(3) (Invention) | 8.9 | 0.99 | 0.79 |

*Relative value expressed in ratio to the reactivity of ExC-17 (Results of the examinations using Samples 101, 102 and 103, respectively).
**Yellow density in the area having the initial yellow density of 1.0 after one day under the condition of 80° C., 70% RH (Results of the examinations using Samples 151, 152 and 153, respectively).
***Yellow density in the area having the initial yellow density of 1.0 after 24-hour exposure to a xenon light source (200,000 lux) (Results of the examinations using Samples 151,152, and 153, respectively).

As can be seen from the data of Table 1, the comparative coupler ExY-13, although it had high activity, was inferior in color image keeping quality, and the other comparative coupler ExCp-16 (disclosed in French Patent 1,558,452) was of very low reactivity and inferior to the coupler Cp-(3) employed in accordance with the present invention in color image keeping quality; while the coupler Cp-(3) had not only high reactivity but also excellent color image keeping quality.

Thus, it can be said that a coupler which is excellent in both reactivity and color image keeping quality is limited to the coupler employed in accordance with the present invention.

EXAMPLE 2

On a cellulose triacetate film support provided with a subbing layer, were coated the layers described below in this order to prepare a multilayer color photosensitive material (Sample 201).

Coverages of silver halides and colloidal silver were expressed in terms of g/m$^2$ based on silver, those of the couplers, the additives and gelatin in terms of g/m$^2$, and those of the sensitizing dyes in terms of mole per mole of silver halide contained in the same layer, as shown below.

| First Layer (Antihalation Layer) | |
|---|---|
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |

-continued

| Second Layer (Interlayer) | |
|---|---|
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer (Low Red-sensitive Emulsion Layer | |
| Silver iodobromide emulsion (AgI: 4.0 mol % uniform AgI type, sphere corresponding diameter: 0.5 micron, variation coefficient of sphere corresponding diameter; 20%, tabular grains, diameter/thickness ratio: 3.0) | 1.2 |
| Silver iodobromide emulsion (AgI: 3 mol %, uniform AgI type, sphere corresponding diameter: 0.3 micron, variation coefficient of sphere corresponding diameter: 15%, spherical grains, diameter/thickness ratio: 1.0) | 0.6 |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Fourth Layer (High-speed Red-sensitive Emulsion Layer) | |
| Silver iodobromide emulsion (AgI: 6 mol %, core/shell ratio of 1:1, high AgI content in the core, sphere corresponding diameter: 0.7 micron, variation coefficient of sphere corresponding diameter: 15%, tabular grains, diameter/thickness ratio: 5.0) | 0.7 |
| Gelatin | 1.0 |
| ExS-1 | $3 \times 10^{-4}$ |
| ExS-2 | $2.3 \times 10^{-4}$ |
| ExC-6 | 0.11 |
| ExC-7 | 0.05 |
| ExC-4 | 0.05 |
| Solv-1 | 0.05 |
| Solv-3 | 0.05 |
| Fifth Layer (Interlayer) | |
| Gelatin | 0.5 |
| Cpd-1 | 0.1 |
| Solv-1 | 0.05 |
| Sixth Layer (Low Green-sensitive Emulsion Layer) | |
| Silver iodobromide emulsion (AgI: 4 mol %, core/shell ratio of 1:1, high AgI content at the surface, sphere corresponding diameter: 0.5 micron, variation coefficient of sphere corresponding diameter: 15%, tabular grains, diameter/thickness ratio: 4.0) | 0.35 |
| Silver iodobromide emulsion (AgI: 3 mol %, uniform AgI type, sphere corresponding diameter: 0.3 micron, variation coefficient of sphere corresponding diameter: 25%, spherical grains, diameter/thickness ratio: 1.0) | 0.6 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer (High-speed Green-sensitive Emulsion Layer) | |
| Silver iodobromide emulsion (AgI: 4 mol %, core/shell ratio of 1:3, high AgI content in the core, sphere corresponding diameter: 0.7 micron, variation coefficient of sphere corresponding diameter: 20%, tabular grains, | 0.8 |

-continued

| | |
|---|---|
| diameter/thickness ratio: 5.0) | |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer (Interlayer) | |
| Gelatin | 0.5 |
| Cpd-1 | 0.05 |
| Solv-1 | 0.02 |
| Ninth Layer (Doner Layer Having Interlayer Effect on Red-sensitive Layer) | |
| Silver iodobromide emulsion (AgI: 2 mole %, core/shell ratio of 2:1, high AgI content in the core, sphere corresponding diameter: 1.0 micron, variation coefficient of sphere corresponding diameter: 15%, tabular grains, diameter/thickness ratio: 6.0) | 0.35 |
| Silver iodobromide emulsion (AgI: 2 mol %, core/shell ratio of 1:1, high AgI content in the core, sphere corresponding diameter: 0.4 micron, variation coefficient of sphere corresponding diameter: 20%, tabular grains, diameter/thickness ratio: 6.0) | 0.20 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer (Yellow Filter Layer) | |
| Yellow colloidal silver | 0.05 |
| Gelatin | 0.5 |
| Cpd-2 | 0.13 |
| Solv-1 | 0.13 |
| Cpd-1 | 0.10 |
| Eleventh Layer (Low Blue-sensitive Emulsion Layer) | |
| Silver iodobromide emulsion (AgI: 4.5 mol % uniform AgI type, sphere corresponding diameter: 0.7 micron, variation coefficient of sphere corresponding diameter: 15% tabular grains, diameter/thickness ratio: 7.0) | 0.3 |
| Silver iodobromide emulsion (AgI: 3 mol % uniform AgI type, sphere corresponding diameter: 0.3 micron, variation coefficient of sphere corresponding diameter: 25%, tabular grains, diameter/thickness ratio: 7.0) | 0.15 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.15 |
| ExY-15 | 1.0 |
| Solv-1 | 0.20 |
| Twelfth Layer (High-speed Blue-sensitive Emulsion Layer) | |
| Silver iodobromide emulsion (AgI: 10 mol %, high AgI content inside the grains, sphere corresponding diameter: 1.0 micron, variation coefficient of sphere corresponding diameter: 25%, multitwinning tabular grains, diameter/thickness ratio: 2.0) | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer (First Protective Layer) | |
| Gelatin | 0.8 |
| UV-4 | 0.1 |
| UV-5 | 0.15 |
| Solv-1 | 0.01 |
| Solv-2 | 0.01 |
| Fourteenth Layer (Second Protective Layer) | |
| Fine-grained silver bromide emulsion (AgI: 2 mol %, uniform AgI type, sphere corresponding diameter: 0.07 micron) | 0.5 |
| Gelatin | 0.45 |
| Polymethylmethacrylate particles (diameter: 1.5 microns) | 0.2 |
| H-1 | 0.4 |
| Cpd-5 | 0.5 |
| Cpd-6 | 0.5 |

In addition to the foregoing ingredients, the emulsion stabilizer Cpd-3 (0.04 g/m$^2$) and the surface active agent Cpd-4 as coating aid (0.02 g/m$^2$) were added to each layer.

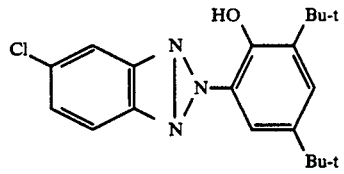

UV-1

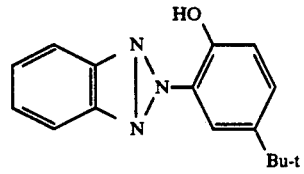

UV-2

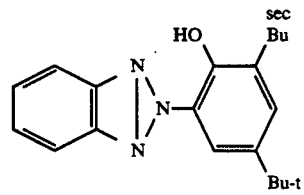

UV-3

-continued
UV-4
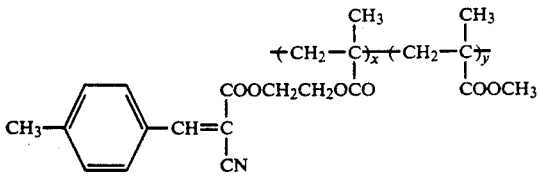
x/y = 7/3 (weight ratio)
UV-5
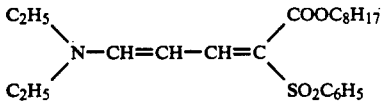
Tricresyl phosphate — Solv-1
Dibutyl phthlate — Solv-2
Solv-3
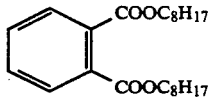
Solv-4
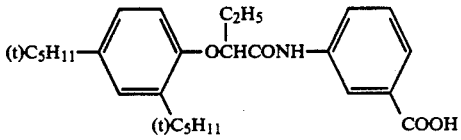
Cpd-1
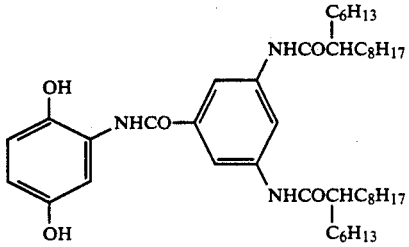
Cpd-2
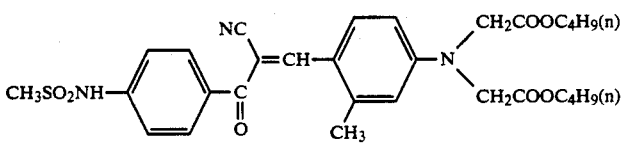
Cpd-3
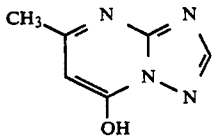
Cpd-4
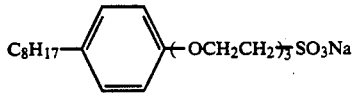
Cpd-5
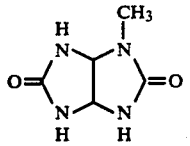
Cpd-6
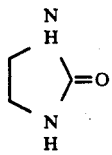

-continued
ExC-1
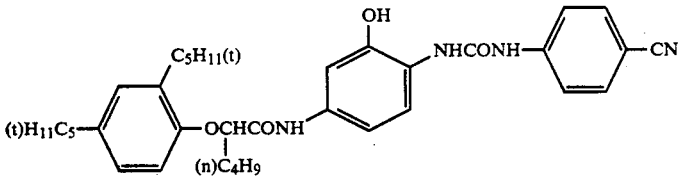
ExC-2
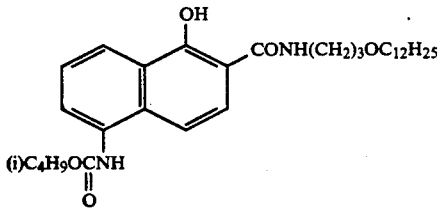
ExC-3
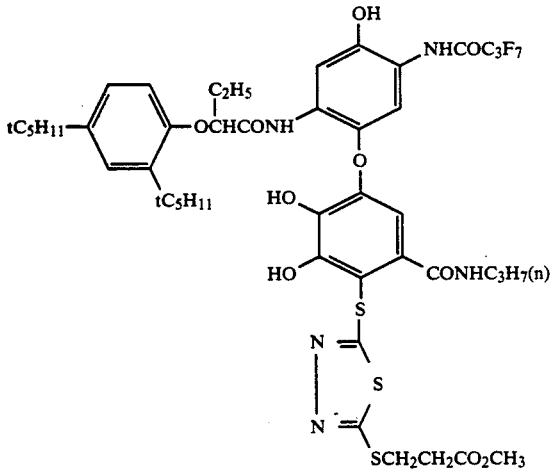
ExC-4
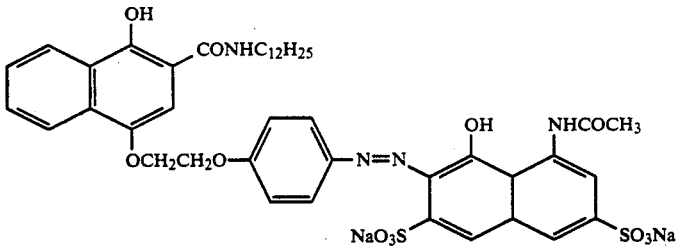
ExC-5
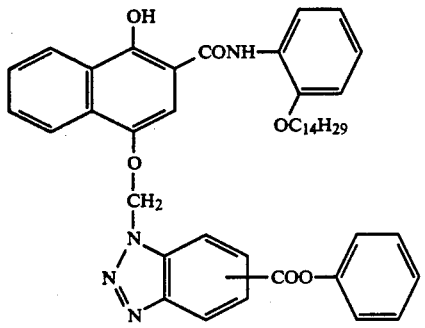

-continued
ExC-6
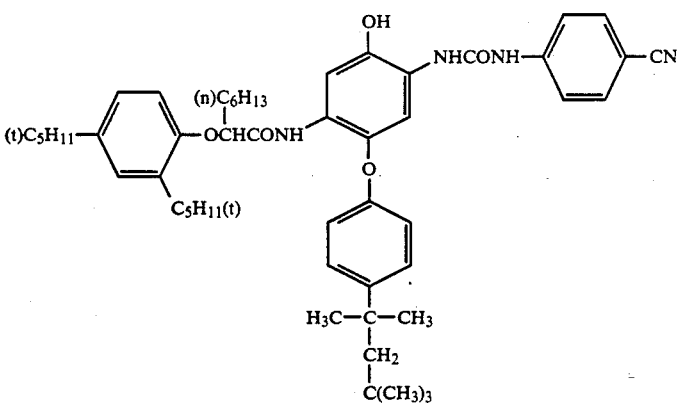
ExC-7
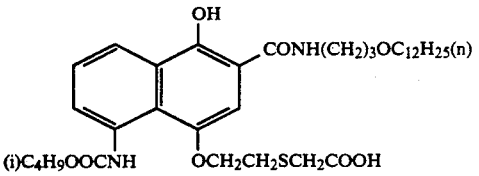
ExM-8
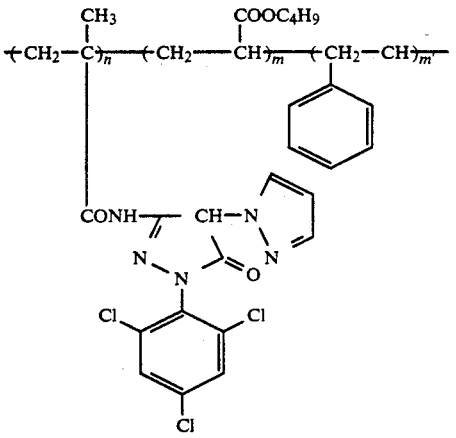
n = 50
m = 25
m' = 25
Mol. Wt. ca. 20,000
ExM-9
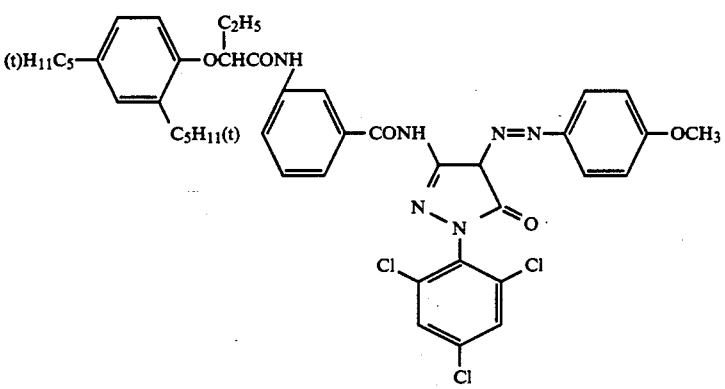

-continued
ExM-10
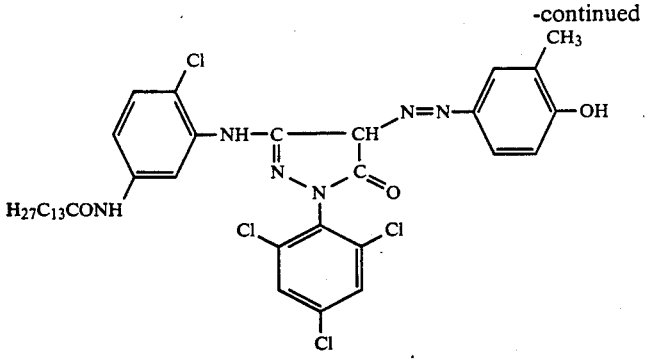
ExY-11
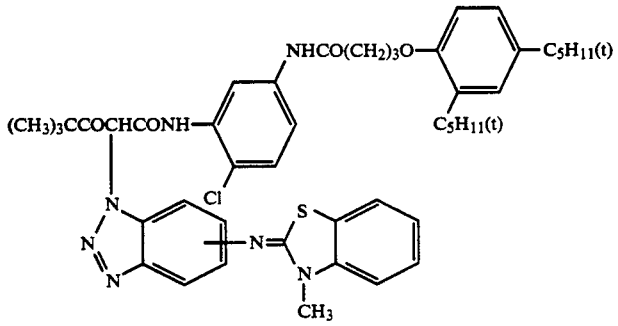
ExM-12
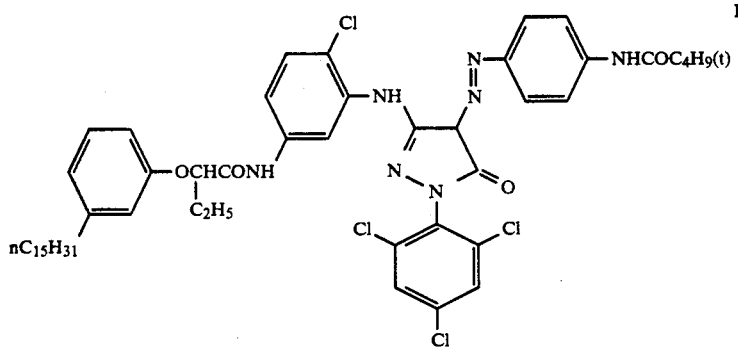
ExY-13
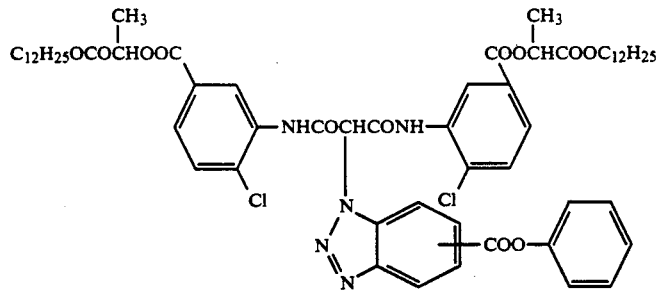
ExM-14
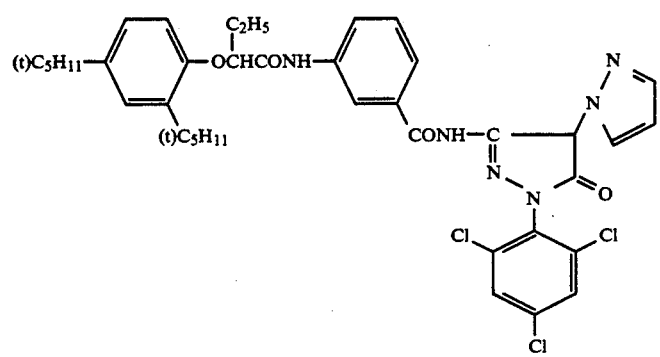

-continued
ExY-15
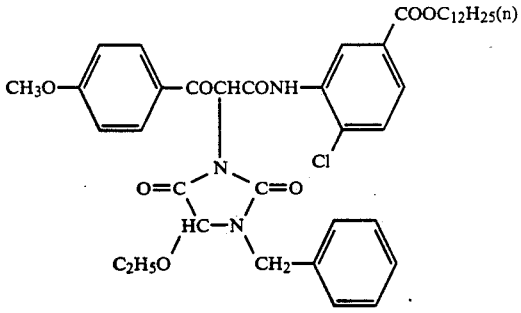
ExC-16
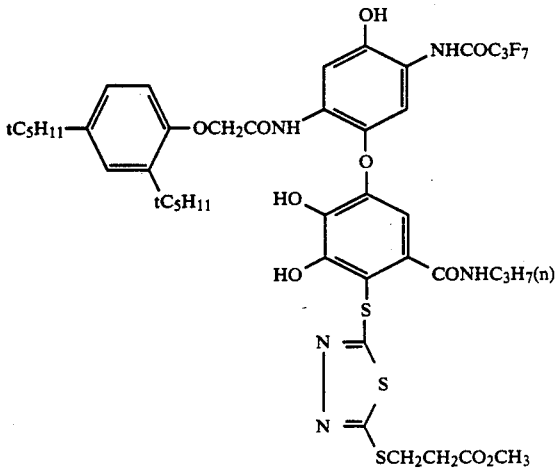
ExS-1
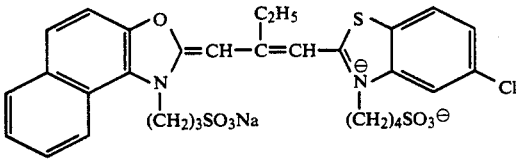
ExS-2
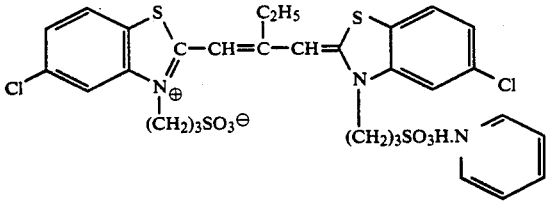
ExS-3
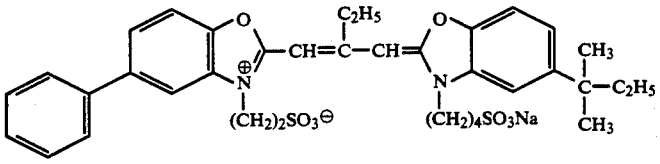
ExS-4
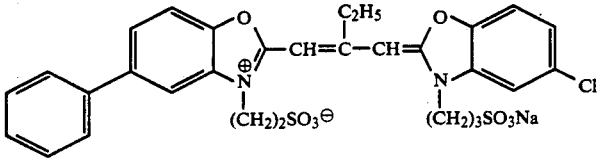

-continued

ExS-5

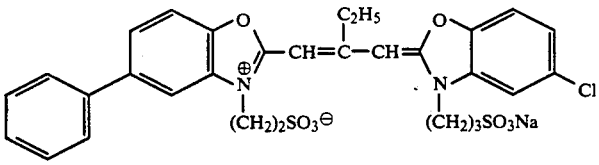

ExS-6

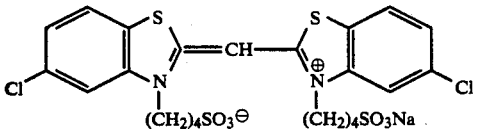

H-1

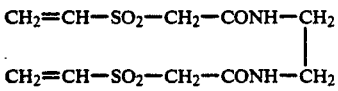

ExF-1

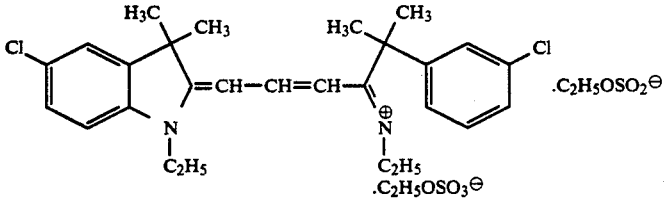

Preparation of Samples 202 to 208

Samples 202 to 208 were prepared in the same manner as Sample 201, except the couplers set forth in Table 2 were used in the place of ExY-13 in amounts equimolar with ExY-13, respectively.

(the coupler disclosed in U.S. Pat. No. 4,149,886) ExCp-1

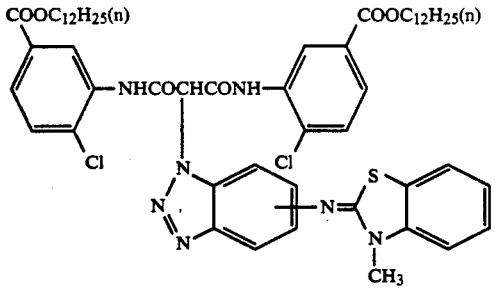

(the coupler disclosed in U.S. Pat. No. 4,477,562) ExCp-15

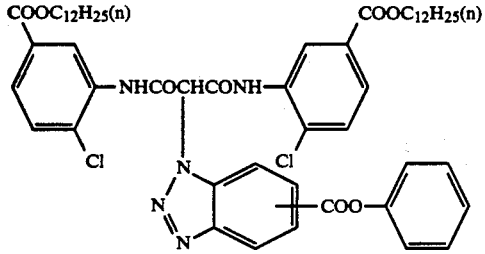

-continued (the coupler disclosed in U.S. Pat. No. 4,477,563) ExCp-34

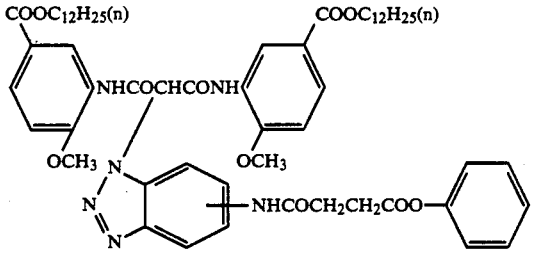

Preparation of Sample 209

Sample 209 was prepared in the same manner as Sample 201, except ExY-13 was excluded.

The Samples 201 to 209 were each exposed wedgewise, and then subjected to the photographic processing described below.

In order to examine the thus processed samples in their individual dye image-keeping qualities, one strip of each sample was allowed to stand in the dark for 4 days at 60° C., 70% RH, and another strip was exposed to a xenon light source (240,000 lux) for 24 hours, and thereby dark discoloration and photodiscoloration were evaluated.

The results obtained are shown in Table 2.

Processing Process

| Step | Processing Time | Processing Temperature |
|---|---|---|
| Color Development | 3 min. 15 sec. | 38° C. |
| Bleaching | 1 min. 00 sec. | 38° C. |
| Bleach-Fix | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

Compositions of the processing solutions used are described below.

| | |
|---|---|
| Color Developer | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 l |
| pH | 10.05 |
| Bleaching Bath | |
| Ammonium ethylenediaminetetraacetato-ferrate(III) Dihydrate | 120.0 g |
| Disodium ethylenediaminetetraacetate | 10.0 g |
| Ammonium bromide | 100.0 g |
| Ammonium nitrate | 10.0 g |
| Bleach accelerator | 0.005 mol |

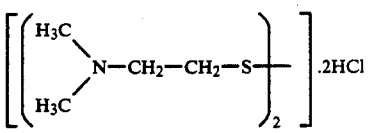

| | |
|---|---|
| Aqueous ammonia (27%) | 15.0 ml |
| Water to make | 1.0 l |
| pH | 6.3 |
| Bleach-Fix Bath | |
| Ammonium ethylenediaminetetraacetato-ferrate(III) dihydrate | 50.0 g |
| Disodium ethylenediaminetetraacetate | 5.0 g |
| Sodium sulfite | 12.0 |
| Aqueous solution of ammonium thiosulfate (70%) | 240.0 ml |
| Aqueous ammonia (27%) | 60 ml |
| Water to make | 1.0 l |
| pH | 7.2 |

Washing Solution

City water was purified by passing it through a mixed-bed column packed with a strongly acidic H-type cation exchange resin (amberlite IR-120B, produced by Rohm & Haas Co.) and an OH-type anion exchange resin (Amberlite IR-400, produced by Rohm & Haas, Co.) till calcium and magnesium ion concentrations were each reduced to 3 mg/λ or less, and ten adding thereto 20 mg/λ of sodium dichloroisocyanurate and 150 mg/λ of sodium sulfate. The pH of the resulting water solution was within the range of 6.5 to 7.5.

| Stabilizing Solution | |
|---|---|
| Formaldehyde (37%) | 2.0 ml |
| Polyoxyethylene-p-monononylphenyl ether (mean polymerization degree: 10) | 0.3 g |
| Disodium ethylenediaminetetraacetate | 0.05 g |
| Water to make | 1.0 l |
| pH | 5.0–8.0 |

TABLE 2

| Sample No. | DIR Coupler | Dark discoloration* | Photodiscoloration** |
|---|---|---|---|
| 201 | ExY-13 (Comparison) | 0.74 | 0.68 |
| 202 | ExCp-1 (Comparison) | 0.76 | 0.71 |
| 203 | Cp-(10) (Invention) | 0.97 | 0.90 |
| 204 | ExCp-15 (Comparison) | 0.76 | 0.70 |
| 205 | ExCp-34 (Comparison) | 0.70 | 0.66 |
| 206 | Cp-(5) (Invention) | 0.98 | 0.91 |
| 207 | Cp-(8) (Invention) | 0.98 | 0.89 |

TABLE 2-continued

| Sample No. | DIR Coupler | Dark discoloration* | Photodiscoloration** |
|---|---|---|---|
| 208 | Cp-(14) (Invention) | 0.97 | 0.90 |
| 209 | Absent (Comparison) | 0.99 | 0.93 |

*Yellow density in the area having the initial yellow density of 1.0 after 4 days under the condition of 60° C., 70% RH.
**Yellow density in the area having the initial yellow density of 1.0 after 24-hour exposure to a xenon light source (240,000 lux).

As can be seen from the data of Table 2, considerable deterioration of both dark discoloration and photodiscoloration resistances was caused in the Comparative Samples 201, 202, 204 and 205, to which the comparative DIR couplers were added respectively, compared with the Sample 209 to which a DIR coupler was not added. However, Samples 203, 206, 207 and 208, made in accordance with the present invention in which the DIR couplers having the structures of the present invention were used respectively suffered only slight deterioration in both dark discoloration and photodiscoloration resistances.

EXAMPLE 3

Each of the Samples 201 to 209 prepared in the same manner as in Example 2 was cut into strips having a width of 35 mm, standard objects were photographed on these strips, and then each sample underwent the 500-meter running test with a color nega processor FP-350, produced by Fuji Photo Film Co., Ltd., in accordance with the following photographic processing.

After the running test, each sample was wedgewise exposed to white light, and then subjected to the following photographic processing treatment, whereby dark discoloration and photodiscoloration were evaluated in accordance with the same method as in Example 2.

Thus, in analogy with Example 2, the samples prepared in Example 3, to which the DIR couplers having the structure of the present invention were added respectively, have proved to be excellent in both dark discoloration and photodiscoloration resistances.

Photographic Processing Process

| Step | Processing Time | Processing Temperature | Amount Replenished | Tank Volume |
|---|---|---|---|---|
| Color Development | 3 min. 15 sec. | 38° C. | 45 ml | 10 l |
| Bleaching | 1 min. 00 sec. | 38° C. | 20 ml | 4 l |
| Bleach-Fix | 3 min. 15 sec. | 38° C. | 30 ml | 10 l |
| Washing (1) | 40 sec. | 35° C. | (*) | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

(*)Replenished with the washing solution over-flowing the washing tank (2) according to the countercurrent process.
Amount replenished: per 1 meter of 35 mm-wide sensitive material.

In the foregoing processing, the amount of the bleach-fix solution brought into the washing tank was 2 ml per 1 meter of 35 mm-wide sensitive material.

Compositions of the processing solutions used are described below.

| | Tank solution | Replenisher |
|---|---|---|
| Color Developer | | |
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | |
| Hydroxylamine sulfate | 2.4 g | 2.8 g |
| 4-(N-Ethyl-N-β-hydroxyethylamino)-2-methylaniline sulfate | 4.5 g | 5.5 g |
| Water to make | 1.0 l | 1.0 l |
| pH | 10.05 | 10.10 |
| Bleaching Bath (Common between Tank solution and Replenisher) | | |
| Ammonium ethylenediaminetetraacetatoferrate(III) dihydrate | 120.0 g | |
| Disodium ethylenediaminetetraacetate | 10.0 g | |
| Ammonium bromide | 100.0 g | |
| Ammonium nitrate | 10.0 g | |
| Bleach accelerator | 0.005 mol | |

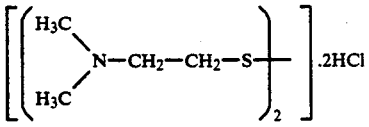

| | | |
|---|---|---|
| Aqueous ammonia (27%) | 15.0 ml | |
| Water to make | 1.0 l | |
| pH | 6.3 | |
| Bleach-Fix Bath (Common between tank solution and Replenisher) | | |
| Ammonium ethylenediaminetetraacetatoferrate(III) dihydrate | 50.0 g | |
| Disodium ethylenediaminetetraacetate | 5.0 g | |
| Sodium sulfite | 12.0 | |
| Aqueous solution of ammonium thiosulfate (70%) | 240.0 ml | |
| Aqueous ammonia (27%) | 6.0 ml | |
| Water to make | 1.0 l | |
| pH | 7.2 | |

Washing Solution

Common between Tank solution and Replenisher

City water was purified by passing it through a mixed-bed column packed with a strongly acidic H-type cation exchange resin (Amberlite IR-120B, produced by Rohm & Haas Co.) and an OH-type anion exchange resin (Amberlite IR-400, produced by Rohm & Haas, Co.) till calcium and magnesium ion concentrations were each reduced to 3 mg/λ or less, and then adding thereto 20 mg/λ of sodium dichloroisocyanurate and 150 mg/λ of sodium sulfate. The pH of the resulting water solution was within the range of 6.5 to 7.5.

| Stabilizing Solution (Common between Tank solution and Replenisher) | |
|---|---|
| Formaldehyde (37%) | 2.0 ml |
| Polyoxyethylene-p-monononylphenyl ether (mean polymerization degree: 10) | 0.3 g |
| Disodium ethylenediaminetetraacetate | 0.05 g |
| Water to make | 1.0 l |
| pH | 5.0–8.0 |

EXAMPLE 4

Dark discoloration and photodiscoloration were evaluated for strips of Samples 201 to 209 which were exposed and tested for dark discoloration and photodiscoloration according to the same test as in Example 3. The strips employed in the present Example 4 were subjected to the following photographic processing process instead of the photographic processing process employed in Example 3.

Thus, in analogy with Example 2, the samples to which the DIR couplers having the structure of the present invention were added respectively, have proved to be excellent in both dark discoloration and photodiscoloration resistances under the processing of Example 4 also.

Photographic Processing Process

| Step | Processing Time | Processing Temperature | Amount Replenished | Tank Volume |
|---|---|---|---|---|
| Color Development | 2 min. 30 sec. | 40° C. | 10 ml | 8 l |
| Bleach-Fix | 3 min. 00 sec. | 40° C. | 20 ml | 8 l |
| Washing (1) | 20 sec. | 35° C. | (*) | 2 l |
| Washing (2) | 20 sec. | 35° C. | 10 ml | 2 l |
| Stabilization | 20 sec. | 35° C. | 10 ml | 2 l |
| Drying | 50 sec. | 65° C. | | |

(*)Replenished with the washing solution over-flowing the washing tank (2) according to the countercurrent process.

The amounts replenished were per 1 meter of 35 mm-wide sensitive material.

Compositions of the processing solutions used are described below.

| | Mother Liquor | Replenisher |
|---|---|---|
| Color Developer | | |
| Diethylenetriaminepentaacetic acid | 2.0 g | 2.2 g |
| 1-Hydroxyethylidene-1,1-diphosphonic acid | 3.0 g | 3.2 g |
| Sodium sulfite | 4.0 g | 5.5 g |
| Potassium carbonate | 30.0 g | 45.0 g |
| Potassium bromide | 1.4 g | — |
| Potassium iodide | 1.5 mg | — |
| Hydroxylamine sulfate | 2.4 g | 3.0 g |
| 4-[N-Ethyl-N-(β-hydroxyethyl)-amino]-2-methylaniline sulfate | 4.5 g | 7.5 g |
| Water to make | 1.0 l | 1.0 l |
| pH | 10.05 | 10.20 |
| Bleach-Fix Bath (Common between Tank solution and Replenisher) | | |
| Ammonium ethylenediaminetetraacetatoferrate(III) | 50.0 g | |
| Disodium ethylenediaminetetraacetate | 5.0 g | |
| Sodium sulfite | 12.0 g | |
| Aqueous solution of ammonium thiosulfate (70%) | 260.0 ml | |
| Acetic acid (98%) | 5.0 ml | |
| Bleach accelerator | 0.01 mol | |

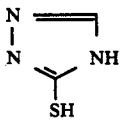

| | |
|---|---|
| Water to make | 1.0 l |
| pH | 6.0 l |

Washing Solution

Common between Tank solution and Replenisher

City water was purified by passing it through a mixed-bed column packed with a strongly acidic H-type cation exchange resin (Amberlite IR-120B, produced by Rohm & Haas Co.) and an OH-type anion exchange resin (Amberlite IR-400, produced by Rohm & Haas, Co.) till calcium and magnesium ion concentrations were each reduced to 3 mg/λ or less, and then adding thereto 20 mg/λ of sodium dichloroisocyanurate and 150 mg/λ of sodium sulfate. The pH of the resulting water solution was within the range of 6.5 to 7.5.

| Stabilizing Solution (Common between Tank solution and Replenisher) | |
|---|---|
| Formaldehyde (37%) | 2.0 ml |
| Polyoxyethylene-p-monononylphenyl ether (mean polymerization degree: 10) | 0.3 g |
| Disodium ethylenediaminetetraacetate | 0.05 g |
| Water to make | 1.0 l |
| pH | 5.0–8.0 |

EXAMPLE 5

On a cellulose triacetate film support provided with a subbing layer, were coated the layers described below in this order to prepare a multilayer color photographic material (Sample 501).

With respect to the compositions of the layers, coated amounts are shown in a unit of g/m$^2$, coated amounts of silver halide and colloidal silver are shown by a coated amount in a unit of g/m$^2$, those of sensitizing dyes are shown using a molar amount per mol of silver halide present in the same layer.

| | |
|---|---|
| First Layer (Antihalation Layer) | |
| Black Colloidal silver | as silver 0.18 |
| Gelatin | 0.40 |
| Second Layer (Interlayer) | |
| 2,5-di-t-pentadecyl hydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer | |
| (First Red-sensitive Emulsion Layer) | |
| Emulsion A | as silver 0.25 |
| Emulsion B | as silver 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-10 | 0.020 |
| HBS-1 | 0.060 |
| Gelatin | 1.30 |
| Fouth Layer | |
| (Second Red-sensitive Emulsion Layer) | |
| Emulsion G | as silver 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.050 |
| EX-10 | 0.015 |
| HBS-1 | 0.060 |
| Gelatin | 1.30 |
| Fifth Layer | |

-continued

| | |
|---|---|
| (Third Red-sensitive Emulsion Layer) | |
| Emulsion D | as silver 1.60 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Sixth Layer (Interlayer) | |
| EX-5 | 0.040 |
| HBS-1 | 0.020 |
| Gelatin | 0.80 |
| Seventh Layer | |
| (First Green-sensitive Emulsion Layer) | |
| Emulsion A | as silver 0.15 |
| Emulsion B | as silver 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| Eighth Layer | |
| (Second Green-sensitive Emulsion Layer) | |
| Emulsion C | as silver 0.45 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |
| Ninth Layer | |
| (Third Green-sensitive Emulsion Layer) | |
| Emulsion E | as silver 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Tenth Layer (Yellow Filter Layer) | |
| Yellow Colloidal silver | as silver 0.05 |
| EX-5 | 0.08 |
| HBS-1 | 0.03 |
| Gelatin | 0.95 |
| Eleventh Layer | |
| (First Blue-sensitive Emulsion Layer) | |
| Emulsion A | as silver 0.08 |
| Emulsion B | as silver 0.07 |
| Emulsion F | as silver 0.07 |
| Sensitizing Dye VIII | $3.5 \times 10^{-4}$ |
| EX-9 | 0.721 |
| EX-8 | 0.21 |
| HBS-1 | 0.28 |
| Gelatin | 1.10 |
| Twelfth Layer | |
| (Second Blue-sensitive Emulsion Layer) | |
| Emulsion G | as silver 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Thirteenth Layer | |
| (Third Blue-sensitive Emulsion Layer) | |
| Emulsion H | as silver 0.77 |
| Sensitizing Dye VIII | $2.2 \times 10^{-4}$ |

-continued
| | |
|---|---|
| EX-9 | 0.20 |
| HBS-1 | 0.69 |
| Fourteenth Layer | |
| (First Protective Layer) | |
| Emulsion I | as silver 0.5 |
| U-4 | 0.11 |
| U-5 | 0.17 |
| HBS-1 | 0.05 |
| Gelatin | 1.00 |
| Fifteenth Layer | |
-continued
| | |
|---|---|
| (Second Protective Layer) | |
| Polymethylmethacrylate particles (diameter: 1.5 μm) | 0.54 |
| S-1 | 0.20 |
| Gelatin | 1.20 |
In addition to the foregoing ingredients, the gelatin hardner H-1 and a surface active agent were added to each layer.
EX-1
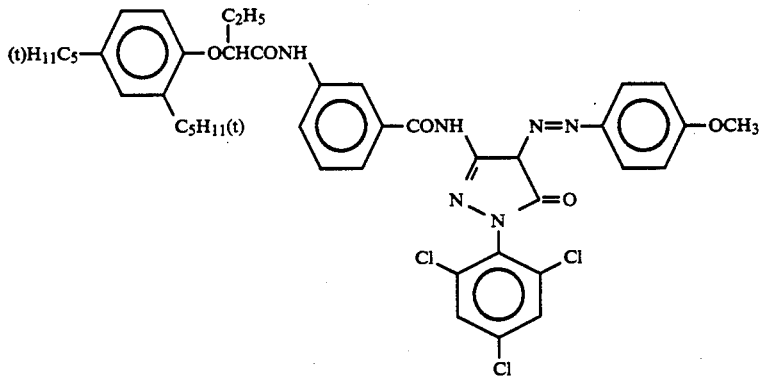
EX-2
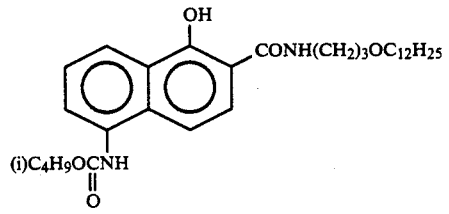
EX-3
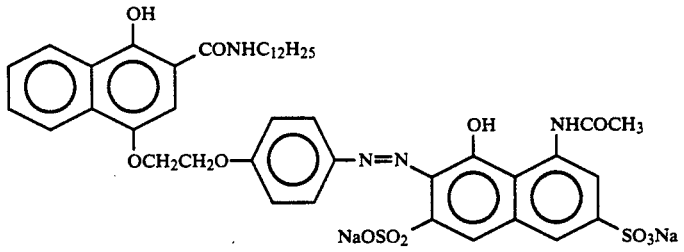
EX-4
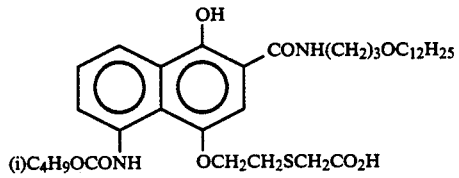
EX-5
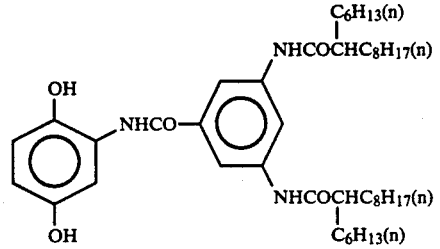

-continued
EX-6
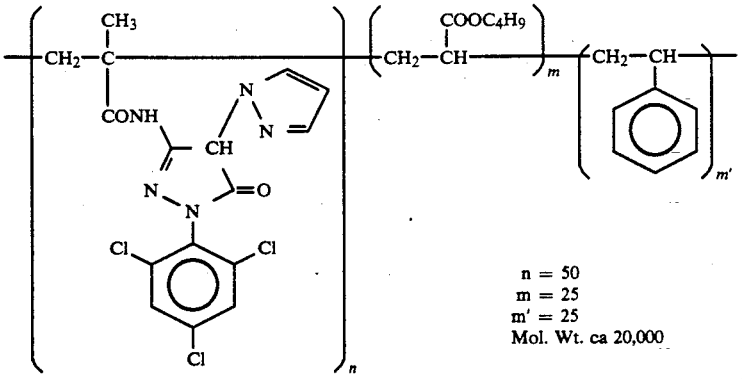
EX-7
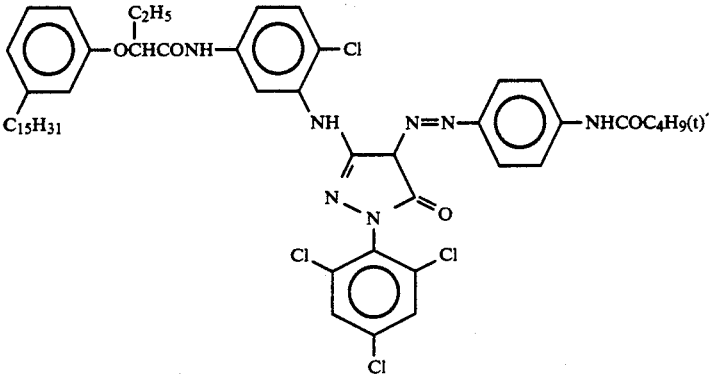
EX-8
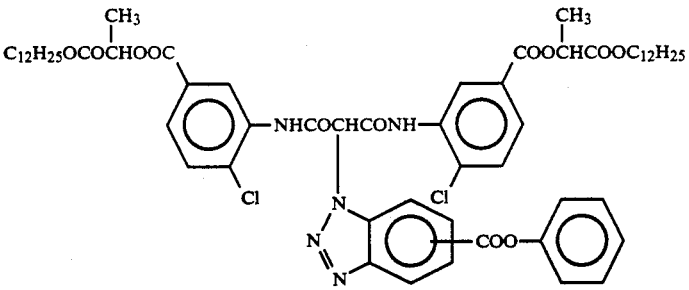
EX-9
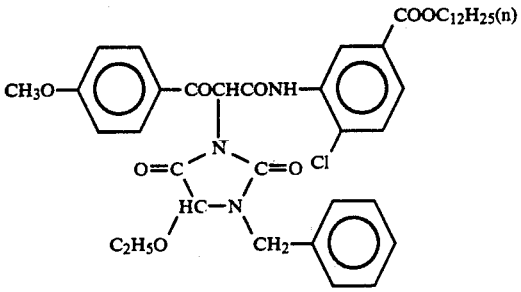

-continued
EX-10
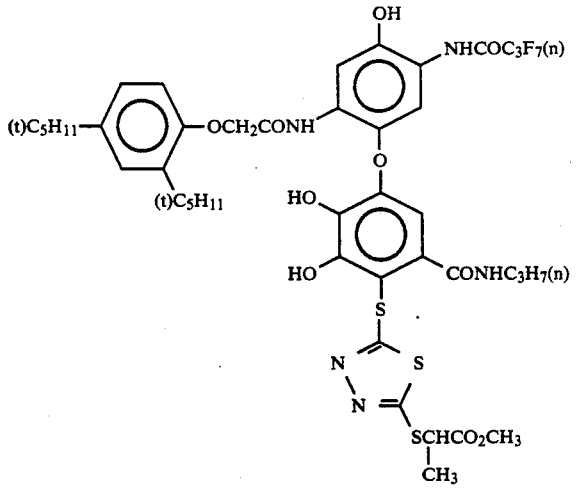
EX-11
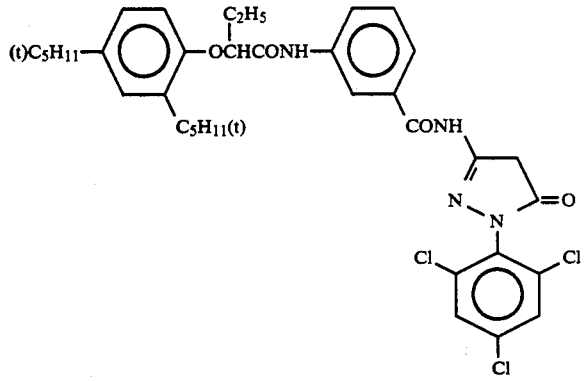
EX-12
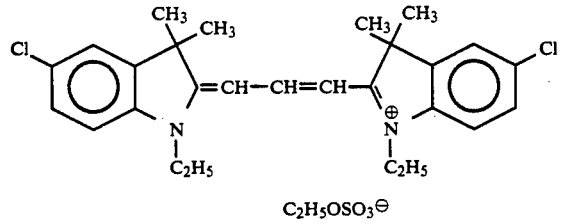
EX-13
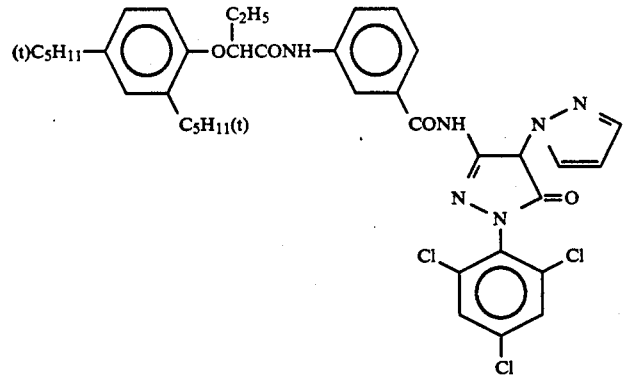
U-1
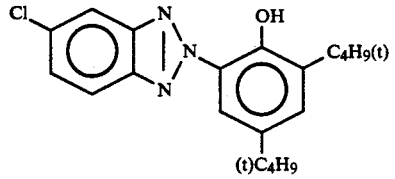

-continued
U-2
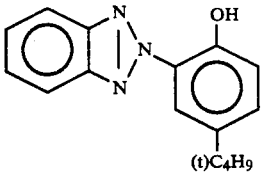
U-3
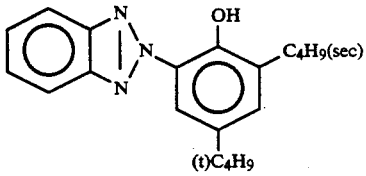
U-4
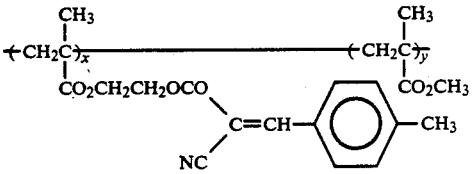
x:y = 70:30 (wt %)
UV-5
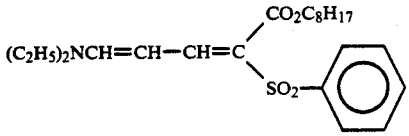
Tricresyl phosphate — HBS-1
Di-n-butyl phthalate — HBS-2
HBS-3
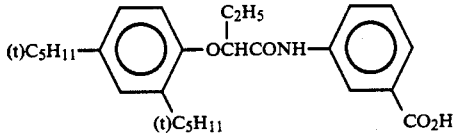
Sensitizing Dye I
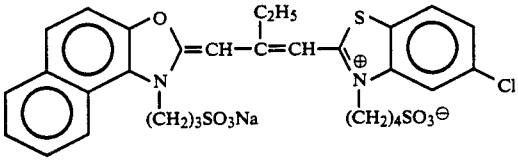
Sensitizing Dye II
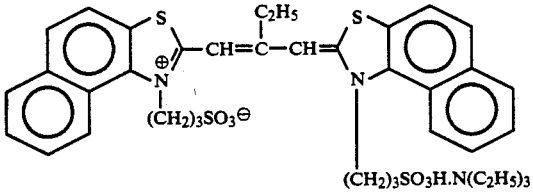
Sensitizing Dye III
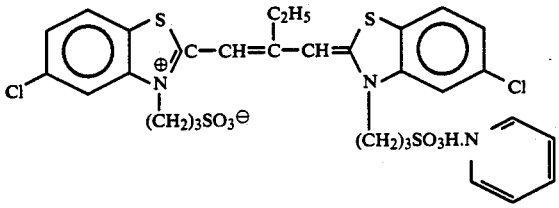

-continued

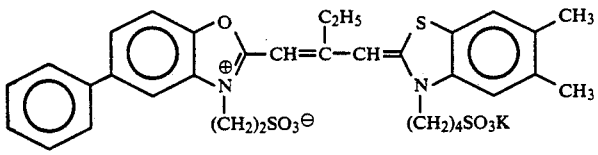

Sensitizing Dye V

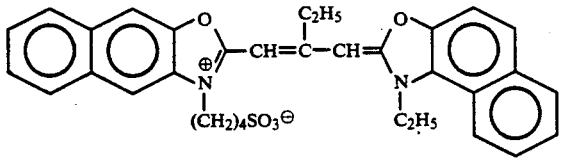

Sensitizing Dye VI

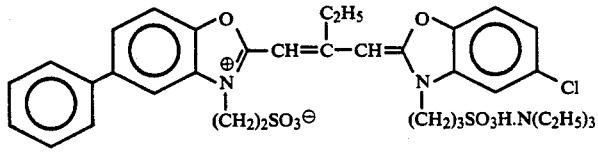

Sensitizing Dye VII

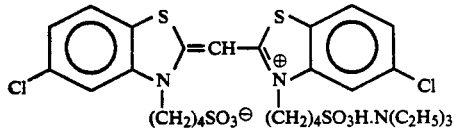

Sensitizing Dye VIII

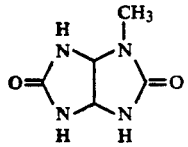

S-1

$CH_2{=}CH{-}SO_2{-}CH_2{-}CONH{-}CH_2$
$CH_2{=}CH{-}SO_2{-}CH_2{-}CONH{-}CH_2$

H-1

TABLE 3

| Emulsion | Average AgI Content (%) | Average Grain Size (μm) | Variation Coefficient of Grain Size (%) | Diameter/thickness | Silver Amount Ratio (AgI content %) |
|---|---|---|---|---|---|
| A | 4.1 | 0.45 | 27 | 1 | Core/Shell = 1/3(13/1), Double layered grain |
| B | 8.9 | 0.70 | 14 | 1 | Core/Shell = 3/7(25/2), Double layered grain |
| C | 10 | 0.75 | 30 | 2 | Core/Shell = 1/2(24/3), Double layered grain |
| D | 16 | 1.05 | 35 | 2 | Core/Shell = 1/2(40/0), Double layered grain |
| E | 10 | 1.05 | 35 | 1 | Core/Shell = 1/2(24/3), Double layered grain |
| F | 4.1 | 0.25 | 28 | 1 | Core/Shell = 1/3(13/1), Double layered grain |
| G | 13.6 | 0.75 | 25 | 2 | Core/Shell = 1/2(40/0), Double layered grain |
| H | 14 | 1.30 | 25 | 3 | Core/Shell = 37/63(34/3), Double layered grain |
| I | 1 | 0.07 | 15 | 1 | Uniform grain |

Preparation of Samples 502–510

Samples 502 to 509 were prepared in the same manner as Sample 501, except in the eleventh layer the couplers set forth in Table 4 were used in the place of EX-8 in the same molar amount as EX-8, respectively. Sample 510 was prepared in the same manner as Sample 501, except EX-8 was removed from the eleventh layer.

(1) Image stability and (2) Interlayer effect of the Samples 501 to 510 were evaluated as below:

(1) Image Stability

The Samples 501 to 510 were wedgewise exposed to white light and processed in accordance with the process described below. The processed Samples 501 to 510 were stored for 10 days at 60° C., 70%RH in a dark place. Yellow density of each samples was measured and the image stability of each samples was evaluated by the dye remaining ratio.

(2) Interlayer Effect

The Samples 501 to 510 were exposed and processed in the same manner as (1). Magenta density of Samples 501 to 510 was measured and interlayer effect of each samples was evaluated by the value subtracting the maximum magenta density of Samples 501 to 509 from the maximum magenta density of Sample 510. These results are shown in Table 4 below.

It is apparent from the results that Samples 502 to 509 using the coupler of the present invention show a extremely high image storability and a great interlayer effect.

The color photographic light-sensitive materials, Samples 501 to 510 were exposed to light, and then processed by a cine-type automatic developing machine in accordance with the following method until the accumulated supply amount of the processing solution reached 3 times the volume of the tank. Then the above tests were carried out.

| | Processing method | | | |
|---|---|---|---|---|
| Step | Processing time | Processing temperature (°C.) | Replenisher amount | Tank volume |
| Color Development | 3 min. 15 sec. | 37.8 | 23 ml | 10 l |
| Bleach | 45 sec. | 38.0 | 5 ml | 5 l |
| Fixing | 1 min. 30 sec. | 38.0 | 30 ml | 10 l |
| Stabilization (1) | 20 sec. | 38.0 | — | 5 l |
| Stabilization (2) | 20 sec. | 38.0 | — | 5 l |
| Stabilization (3) | 20 sec. | 38.0 | 30 ml | 5 l |
| Drying | 1 min. | 55.0 | | |

The replenisher amount was represented by the amount supplied per 35mm with and 1m length.

The stabilization is a countercurrent process from (3) to (1).

The carrying over of the developer to the bleach stop and the carrying over of the fixing solution to the stabilization step were 2.5 ml and 2.0 ml, respectively, per 35mm width and 1m length.

The composition of the processing solutions used will be described hereinafter.

| | Tank solution | Replenisher |
|---|---|---|
| Color Developer | | |
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | — |
| Potassium iodide | 1.5 gm | — |
| Hydroxylamine sulfate | 2.4 g | 3.6 g |
| 4-(N-Ethyl-N-β-hydroxyethylamino)-2-methylaniline sulfate | 4.5 g | 6.4 g |
| Water to make | 1.0 l | 1.0 l |
| pH | 10.5 | 10.0 |
| Bleaching Solution | | |
| 1,3-Diaminopropane tetraacetic acid ferric ammonium monohydrate | 144 g | 206 g |
| 1,3-Diaminopropane tetraacetate | 2.8 g | 4.0 g |
| Ammonium bromide | 84.0 g | 120.0 g |
| Aqueous ammonia (27%) | 10.0 g | 1.8 g |
| Acetic acid (98%) | 51.1 g | 73.0 g |
| Water to make | 1.0 l | 1.0 l |
| pH | 4.3 | 3.4 |

-continued

| | Tank solution | Replenisher |
|---|---|---|
| Fixing Solution (Common between Tank solution and Replenisher) | | |
| Disodium ethylenediaminetetraacetate | 1.7 g | |
| Sodium sulfite | 14.0 g | |
| Sodium bisulfite | 10.0 g | |
| Aqueous solution of ammonium thiosulfate (70 w/v) | 210.0 ml | |
| Ammonium thiocyanate | 163.0 g | |
| Thiourea | 1.8 g | |
| Water to make | 1.0 l | |
| pH | 6.5 | |
| Stabilization Bath (Common between Tank solution and Replenisher) | | |
| Formalin (37%) | 1.2 ml | |
| 5-chloro-2-methyl-4-isothiazoline-3-one-2-methyl-4-isothiazoline-3-one | 6.0 mg | |
| 2-Methyl-4-isothiazoline-3-one | 3.0 mg | |
| Surface active agent ($C_{10}H_{21}$-($CH_2CH_2O$)$_{10}$H) | 0.4 g | |
| Ethyleneglycol | 1.0 g | |
| Water to make | 1.0 l | |
| pH | 5.0 to 7.0 | |

TABLE 4

| Sample No. | Coupler used in 11th layer | Image Stability (%) | Interlayer Effect | Remarks |
|---|---|---|---|---|
| 501 | EX-8 | 79 | 0.08 | Comparison |
| 502 | Cp-(5) | 88 | 0.06 | Invention |
| 503 | Cp-(8) | 96 | 0.08 | " |
| 504 | Cp-(14) | 94 | 0.07 | " |
| 505 | Cp-(27) | 95 | 0.07 | " |
| 506 | Cp-(28) | 96 | 0.08 | " |
| 507 | Cp-(1) | 89 | 0.05 | " |
| 508 | Cp-(9) | 94 | 0.08 | " |
| 509 | Cp-(22) | 95 | 0.07 | " |
| 510 | — | 98 | control | Comparison |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one silver halide emulsion layer on a support, said photographic material containing at least one coupler represented by the following general formula (I) in a constituent layer:

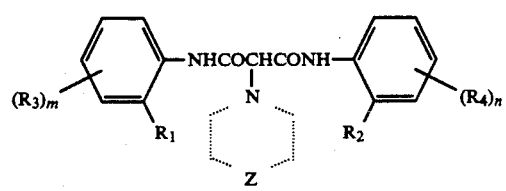

(I)

wherein $R_1$ and $R_2$, which may be the same or different, each represents an alkyl group containing 6 to 24 carbon atoms, an alkylthio group containing 6 to 24 carbon atoms, an alkylsulfonyl group containing 6 to 24 carbon atoms, an alkoxycarbonyl group containing 6 to 24 carbon atoms, an alkoxysulfonyl group containing 6 to 24 carbon atoms, an aryl group containing 6 to 24 carbon atoms, an aryloxy group containing 6 to 24 carbon atoms, an arylthio group containing 6 to 24 carbon atoms, and an arylsulfonyl group containing 6 to 24 carbon atoms; $R_3$ and $R_4$, which may be the same or different, each represents a group by which benzene can be substituted; Z represents nonmetal atoms necessary to form a 5- to 7-membered single or condensed hereto ring together with the nitrogen atom; and m and n each represents an integer of from 0 to 4, and when they are each a plural number, a plural $R_3$ or a plural $R_4$ may be the same or different.

2. The material according to claim 1, wherein the alkyl or aryl moiety of the $R_1$ and $R_2$ groups is substituted by a halogen atom, an alkoxy group, an aryloxy group, an alkylthio group, an arylthio group, an aryl group, an alkoxycarbonyl group, a carbamoyl group, a carbonamido group, a sulfonamido group, a sulfamoyl group, a hydroxyl group, an acyl group, an acyloxy group, an imido group, an alkylsulfonyl group, and an arylsulfonyl group.

3. The material according to claim 1, wherein the alkyl moiety of $R_1$ and $R_2$ has a branched-chain or cyclic structure.

4. The material according to claim 1, wherein the aryl moiety of $R_1$ and $R_2$ is substituted by an alkyl group.

5. The material according to claim 1, wherein $R_1$ and $R_2$ each represents an alkoxy group, an alkylsulfonyl group, or an alkoxycarbonyl group.

6. The material according to claim 1, wherein $R_1$ and $R_2$ each represents an alkylsulfonyl group or an alkoxycarbonyl group.

7. The material according to claim 1, wherein the number of carbon atoms contained in the group represented by $R_1$ or $R_2$ ranges from 6 to 16.

8. The material according to claim 1, wherein $R_3$ and $R_4$ are selected from a halogen atom, an alkyl group, an aryl group, an alkoxy group, an aryloxy group, an alkylthio group, an arylthio group, an alkylsulfonyl group, an arylsulfonyl group, an acyl group, an acyloxy group, a carbonamido group, a sulfonamido group, a hydroxyl group, a carboxyl group, a sulfo group, a cyano group, an alkoxycarbonyl group, an aryloxycarbonyl group an amino group, a heterocyclic group, an imido group, a carbamoyl group, and a sulfamoyl group.

9. The material according to claim 1, wherein m and n are each an integer of from 0 to 2.

10. The material according to claim 1, wherein the total number of carbon atoms contained in $(R_3)_m$ or $(R_4)_n$ is from 0 to 24.

11. The material according to claim 1, wherein at least one m and n represents zero and at least one of $R_3$ and $R_4$ represents an electron attractive group.

12. The material according to claim 1, wherein both of m and n is not zero and at least one of $R_3$ and $R_4$ represents an electron attractive group.

13. The material according to claim 11, wherein the $\sigma p$ value of said electron attractive group is not less than zero.

14. The material according to claim 12, wherein the $\sigma p$ value of said electron attractive group is not less than zero.

15. The material according to claim 1, wherein the amount of said coupler is from $1\times10^{-4}$ to 5 mol% to the total silver coverage.

16. The material according to claim 1, wherein the amount of said coupler is from $1\times10^{-3}$ to 1 mol% to the total silver coverage.

17. A silver halide color photographic material having at least one silver halide emulsion layer on a support, said photographic material containing at least one coupler represented by the following general formula (I) in a constituent layer:

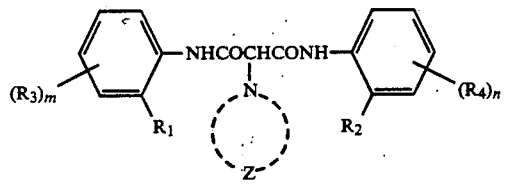

(I)

wherein $R_1$ and $R_2$, which may be the same of different, each represents an alkyl group containing 2 to 5 carbon atoms, an alkylthio group containing 2 to 5 carbon atoms, an alkylsulfonyl group containing 2 to 5 carbon atoms, an alkoxycarbonyl group containing 2 to 5 carbon atoms, an aryl group containing 6 to 24 carbon atoms, an aryloxy group containing 6 to 24 carbon atoms, an arylthio group containing 6 to 24 carbon atoms, an arylsulfonyl group containing 6 to 24 carbon atoms, and an aryloxycarbonyl group containing 7 to 24 carbon atoms; $R_3$ and $R_4$, which may be the same of different, each represents a group by which benzene can be substituted; Z represents nonmetal atoms necessary to form a 5- to 7-membered single or condensed hereto ring together with the nitrogen atom; and m and n each represents an integer of from 0 to 4, and when they are each a plural number, a plural $R_3$ or a plural $R_4$ may be the same or different.

18. The material according to claim 17, wherein the alkyl or aryl moiety of the $R_1$ and $R_2$ groups is substituted by a halogen atom, an alkoxy group, an aryloxy group, an alkylthio group, an arylthio group, an aryl group, an alkoxycarbonyl group, a carbamoyl group, a carbonamido group, a sulfonamido group, a sulfamoyl group, a hydroxyl group, an acyl group, an acyloxy group, an imido group, an alkylsulfonyl group, and an arylsulfonyl group.

19. The material according to claim 17, wherein the alkyl moiety of $R_1$ and $R_2$ has a branched-chain or cyclic structure.

20. The material according to claim 17, wherein the aryl moiety of $R_1$ and $R_2$ is substituted by an alkyl group.

21. The material according to claim 17, wherein $R_1$ and $R_2$ each represents an alkylsulfonyl group, or an alkoxycarbonyl group.

22. The material according to claim 17, wherein $R_1$ and $R_2$ each represents an alkylsulfonyl group or an alkoxycarbonyl group.

23. The material according to claim 17, wherein $R_3$ and $R_4$ are selected from a halogen atom, an alkyl group, an aryl group, an alkoxy group, an aryloxy group, an alkylthio group, an arylthio group, an alkylsulfonyl group, an arylsulfonyl group, an acyl group, an acyloxy group, a carbonamido group, a sulfonamido group, a hydroxyl group, a carboxyl group, a sulf group, a cyano group, an alkoxycarbonyl group, an aryloxycarbonyl group, an amino group, a heterocyclic group, an imido group, a carbamoyl group, and a sulfamoyl group.

24. The material according to claim 17, wherein m and n are each an integer of from 0 to 2.

25. The material according to claim 17, wherein the total number of carbon atoms contained in $(R_3)_m$ or $(R_4)_n$ is from 0 to 24.

26. The material according to claim 17, wherein

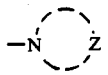

is represented by the following general formula (II):

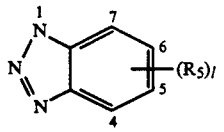

(II)

wherein $R_5$ represents a halogen atom, a nitro group, a cyano group, an amino group, an alkyl group, an aryl group, an alkoxy group, an aryloxy group, an alkoxycarbonyl group, an aryloxycarbonyl group, an alkylthio group, an arylthio group, a thiazolylideneamino group, an alkylsulfonyl group, an arylsulfonyl group, an acyloxy group, a carbonamido group, a sulfonamido group, a carbamoyl group, a sulfamoyl group, an imido group, an alkoxycarbonylamino group, an aryloxycarbonylamino group, or an ureido group and λ represents an integer of from 0 to 4.

27. The material according to claim 26, wherein the total number of the carbon atoms contained in $(R_5)_\lambda$ is from 0 to 10.

28. The material according to claim 17, wherein at least one m and n represents zero and a least one of $R_3$ and $R_4$ represents an electron attractive group.

29. The material according to claim 17, wherein both of m and n is not zero and at least one of $R_3$ and $R_4$ represents an electron attractive group.

30. The material according to claim 28, wherein the σp value of said electron attractive group is not less than zero.

31. The material according to claim 29, wherein the σp value of said electron attractive group is not less than zero.

32. The material according to claim 17, wherein the amount of said coupler is from $1\times10^{-4}$ to 5 mol% to the total silver coverage.

33. The material according to claim 17, wherein the amount of said couple is from $1\times10^{-4}$ to 5 mol% to the total silver coverage.

34. A silver halide color photographic material having at least one silver halide emulsion layer on a support, said photographic material containing at least one coupler represented by the following general formula (I) in a constituent layer:

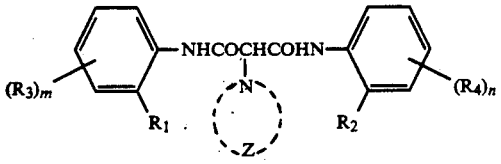

(I)

wherein $R_1$ and $R_2$, which may be the same or different, each represents an alkyl group containing 6 to 24 carbon atoms, an alkoxy group containing 6 to 24 carbon atoms, an alkylthio group containing 6 to 24 carbon atoms, an alkylsulfonyl group containing 6 to 24 carbon atoms, an alkoxycarbonyl group containing 6 to 24 carbon atoms, an alkoxysulfonyl group containing 6 to 24 carbon atoms, an aryl group containing 6 to 24 carbon atoms, an aryloxy group containing 6 to 24 carbon atoms, an arylthio group containing 6 to 24 carbon atoms, an arylsulfonyl group containing 6 to 24 carbon atoms; $R_3$ and $R_4$, which may be the same or different, each represents a group by which benzene can be substituted; m and n represents an integer of from 0 to 4, and when they are each a plural number, a plural $R_3$ or a plural $R_4$ may be the same or different; and wherein

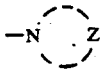

is presented by the following general formula (II):

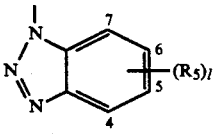

(II)

wherein $R_5$ represents a halogen atom, a nitro group, a cyano group, an amino group, an alkyl group, an aryl group, an alkoxy group, an aryloxy group, an alkoxycarbonyl group, an aryloxycarbonyl group, an alkylthio group, an arylthio group, a thiazolylideneamino group, an alkylsulfonyl group, an arylsulfonyl group, an acyloxy group, a carbonamido group, a sulfonamido group, a carbamoyl group, a sulfamoyl group, an imido group, an alkoxycarbonylamino group, an aryloxycarbonylamino group, or an ureido group and λ represents an integer of from 0 to 4.

35. The material according to claim 34, wherein the total number of the carbon atoms contained in $(R_5)_\lambda$ is from 0 to 10.

36. A silver halide color photographic material having at least one silver halide emulsion layer on a support, said photographic material containing at least one coupler represented by the following general formula (I) in a constituent layer:

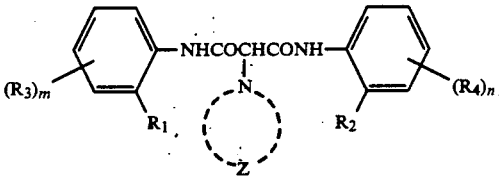

(I)

wherein $R_1$ and $R_2$, which may be the same of different, each represents an alkyl group containing 2 to 5 carbon atoms, an alkoxy group containing 2 to 5 carbon atoms, an alkylthio group containing 2 to 5 carbon atoms, an alkylsulfonyl group containing 2 to 5 carbon atoms, an alkoxycarbonyl group containing 2 to 5 carbon atoms, an alkoxysulfonyl group containing 2 to 5 carbon atoms, an aryl group containing 6 to 24 carbon atoms, an aryloxy group containing 6 to 24 carbon atoms, an arylthio group containing 6 to 24 carbon atoms, an arylsulfonyl group containing 6 to 24 carbon atoms, an aryloxycarbonyl group containing 7 to 24 carbon atoms; $R_3$ and $R_4$, which may be the same of different, each represents a group by which benzene can be substituted; m an d n each represents an integer of from 0 to 4, and when they are each a plural number, a plural $R_3$ or a plural $R_4$ may be the same or different; and wherein

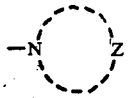

is represented by the following general formula (II):

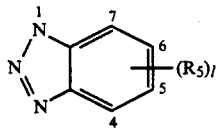

(II)

wherein $R_5$ represents a halogen atom, a nitro group, a cyano group, an amino group, an alkyl group, an aryl group, an alkoxy group, an aryloxy group, an alkoxycarbonyl group, an aryloxycarbonyl group, an alkylthio group, an arylthio group, a thiazolylideneamino group, an alkylsulfonyl group, an arylsulfonyl group, an acyloxy group, a carbonamido group, a sulfonamido group, a carbamoyl group, a sulfamoyl group, an imido group, an alkoxycarbonylamino group, an aryloxycarbonylamuino group, or an ureido group and $\lambda$ represents an integer of from 0 to 4.

37. The material according to claim 36, wherein the total number of the carbon atoms contained in $(R_5)_\lambda$ is from 0 to 10.

* * * * *